US011213889B2

(12) United States Patent
Kondoh

(10) Patent No.: US 11,213,889 B2
(45) Date of Patent: Jan. 4, 2022

(54) OXYGEN SOLID SOLUTION TITANIUM MATERIAL SINTERED COMPACT AND METHOD FOR PRODUCING SAME

(71) Applicants: HI-LEX CORPORATION, Takarazuka (JP); Katsuyoshi Kondoh, Osaka (JP)

(72) Inventor: Katsuyoshi Kondoh, Osaka (JP)

(73) Assignees: Katsuyoshi Kondoh, Osaka (JP); HI-LEX CORPORATION, Takarazuka (JP)

( * ) Notice: Subject to any disclaimer, the term of this patent is extended or adjusted under 35 U.S.C. 154(b) by 210 days.

(21) Appl. No.: 15/773,018

(22) PCT Filed: Oct. 26, 2016

(86) PCT No.: PCT/JP2016/081766
§ 371 (c)(1),
(2) Date: May 2, 2018

(87) PCT Pub. No.: WO2017/077922
PCT Pub. Date: May 11, 2017

(65) Prior Publication Data

US 2018/0311730 A1 Nov. 1, 2018

(30) Foreign Application Priority Data

Nov. 2, 2015 (JP) ..... JP2015-215846

(51) Int. Cl.
*B22F 3/10* (2006.01)
*C22C 14/00* (2006.01)
(Continued)

(52) U.S. Cl.
CPC ..... *B22F 3/1039* (2013.01); *B22F 1/0011* (2013.01); *C22C 1/045* (2013.01);
(Continued)

(58) Field of Classification Search
None
See application file for complete search history.

(56) References Cited

U.S. PATENT DOCUMENTS 3,775,100 A * 11/1973 Kizer ..... B22F 1/025 419/35
2009/0252638 A1* 10/2009 Duz ..... B22F 1/0003 419/37

(Continued)

FOREIGN PATENT DOCUMENTS

JP S5541948 A * 3/1980 ..... C23C 4/06
JP S60224727 A 11/1985

(Continued)

OTHER PUBLICATIONS

Mori, Hisashi, et al. "High strength and high toughness process of β titanium alloy by oxide addition and reduction atmosphere sintering method", Journal of the Society of Materials Science, Japan, vol. 55, No. 4, Apr. 2006, p. 1-2 (Year: 2006).*

(Continued)

*Primary Examiner* — Paul A Wartalowicz
*Assistant Examiner* — Ryan L Heckman
(74) *Attorney, Agent, or Firm* — Hauptman Ham, LLP

(57) ABSTRACT

An oxygen solid solution titanium sintered compact includes a matrix made of a titanium component having an α-phase, oxygen atoms dissolved as a solute of solid solution in a crystal lattice of the titanium component, and metal atoms dissolved as a solute of solid solution in the crystal lattice of the titanium component.

9 Claims, 27 Drawing Sheets

Ti-O binary phase diagram

(51) Int. Cl.

| | |
|---|---|
| ***C22C 1/04*** | (2006.01) |
| ***C22C 32/00*** | (2006.01) |
| ***C22C 1/05*** | (2006.01) |
| ***B22F 1/00*** | (2006.01) |
| ***B22F 3/14*** | (2006.01) |
| ***B22F 3/24*** | (2006.01) |
| ***B22F 3/105*** | (2006.01) |
| ***B22F 3/20*** | (2006.01) |

(52) U.S. Cl.

CPC ..... *C22C 1/05* (2013.01); *C22C 14/00* (2013.01); *C22C 32/001* (2013.01); *C22C 32/0031* (2013.01); *B22F 3/105* (2013.01); *B22F 3/1007* (2013.01); *B22F 3/14* (2013.01); *B22F 3/20* (2013.01); *B22F 2003/1051* (2013.01); *B22F 2003/248* (2013.01); *B22F 2201/10* (2013.01); *B22F 2201/11* (2013.01); *B22F 2301/205* (2013.01); *B22F 2304/10* (2013.01); *B22F 2998/10* (2013.01); *B22F 2999/00* (2013.01)

(56) References Cited

U.S. PATENT DOCUMENTS

| | | | | |
|---|---|---|---|---|
| 2011/0176952 | A1* | 7/2011 | Kruzhanov | C04B 35/01 419/45 |
| 2013/0309122 | A1* | 11/2013 | Mochizuki | C22C 38/10 419/33 |

FOREIGN PATENT DOCUMENTS

| | | | |
|---|---|---|---|
| JP | H051342 | A | 1/1993 |
| JP | 2012241241 | A | 12/2012 |
| WO | 2012160956 | A1 | 11/2012 |

OTHER PUBLICATIONS

Robertson, I., Schaffer, G. Some Effects of Particle Size on the Sintering of Titanium and a Master Sintering Curve Model. Metall and Mat Trans A 40, 1968-1979 (2009) (Year: 2009).*

Williams, J. C., et al. "The Effect of Ternary Additions on the Decompositon of Metastable B-Phase Titanium Alloys." Metallurgical Transactions, vol. 2, No. 2, 1971, pp. 477-484 (Year: 1971).*

Zhang, K., et al. "Effect of Hot-Isostatic-Pressing Parameters on the Microstructure and Properties of Powder Ti—6Al—4V Hot-Isostatically-Pressed Samples." Metallurgical and Materials Transactions A, vol. 41, No. 4, 2010, pp. 1033-1045 (Year: 2010).*

Kobayashi, M, et al. "Manufacturing Process and Mechanical Properties of Fine TiB Dispersed Ti—6Al—4V Alloy Composites Obtained by Reaction Sintering." Materials Science and Engineering: A, vol. 243, No. 1-2, 1998, pp. 279-284 (Year: 1998).*

Yoshimura, Tomohito, et al. "Mechanical Properties of Oxide Dispersion Strengthened Pure Titanium Produced by Powder Metallurgy Method." Materials Science Forum, vol. 654-656, Trans Tech Publications, Ltd., Jun. 2010, pp. 815-818 (Year: 2010).*

Machine Translation of JPS5541948A (Year: 1980).*

Schuh, C., Noël, P., & Dunand, D. C. (2000). Enhanced densification of metal powders by transformation-mismatch plasticity. Acta Materialia, 48(8), 1639-1653 (Year: 2000).*

International Search Report from corresponding International Application No. PCT/JP2016/081766, all pages.

Sumida, Masaki, et al., "In-situ solid phase synthesis of titanium based composite material of Ti5Si3grain dispersion type started from titanium and glass waste," Current advances in materials and processes, vol. 18, 2005, pp. 1-2.

Mori, Hisashi, et al., "High strength and high toughness process of B titanium alloy by oxide addition and reduction atmosphere sintering method," Journal of the Society of Materials Science, Japan, vol. 55, No. 4, Apr. 2006, pp. 1-2.

* cited by examiner

Ti-O binary phase diagram

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

△ Ti ○ Oxide M-O ◆ Ti-M compound ◇ Metal M component

Ordinary-temperature tensile test result of Ti-64 + $ZrO_2$ mixed powder sintered extruded material Tensile test result of Ti-64 + $ZrO_2$ mixed powder sintered extruded material (stress-elongation diagram) (4)

OXYGEN SOLID SOLUTION TITANIUM MATERIAL SINTERED COMPACT AND METHOD FOR PRODUCING SAME

TECHNICAL FIELD

The present invention relates to a high-strength titanium material, and more particularly to an oxygen solid solution titanium sintered compact in which oxygen is dissolved as a solute of solid solution, as well as to a method for producing the same.

BACKGROUND ART

Titanium is a light-weight material having a low specific gravity of about ½ of that of steel and has excellent characteristics in corrosion resistance and strength, so that titanium is used in a component of an aircraft, a railway vehicle, a two-wheel vehicle, an automobile, or the like in which weight reduction is strongly demanded, or in a household electric appliance or an architectural member. Also, from the viewpoint of excellent corrosion resistance, titanium is also used as a material for medical use.

However, as compared with a steel material or an aluminum alloy, titanium has a high material cost, so that an object of use is limited. In particular, though having a high tensile strength exceeding 1000 MPa, a titanium alloy raises a problem of having an insufficient ductility (elongation after fracture) and also having a poor plastic formability at an ordinary temperature or in a low-temperature region. On the other hand, pure titanium raises a problem of low tensile strength of about 400 to 600 MPa, though having a high percentage elongation after fracture exceeding 25% at an ordinary temperature and being excellent in plastic formability in a low-temperature region.

Since the demand for compatibility between a high strength and a high ductility and for reduction of the material cost on titanium is extremely strong, various studies have been made so far. In particular, from the viewpoint of cost reduction, strengthening with use of a comparatively less expensive element such as oxygen instead of a highly expensive element such as vanadium, scandium, or niobium has been studied a lot as a prior art technique.

For example, Japanese Patent Application Laid-open No. 2012-241241 (Patent Document 1) proposes, as a method for producing an oxygen solid solution titanium material, a method of sintering a shaped compact of a mixed powder of titanium powder and $TiO_2$ particles to decompose the $TiO_2$ particles thermally and dissolving the dissociated oxygen atoms as a solute of solid solution into titanium.

CITATION LIST

Patent Literatures

Patent Literature 1; Japanese Unexamined Patent Publication No. 2012-241241

SUMMARY OF INVENTION

Technical Problem

In the method disclosed in Japanese Unexamined Patent Publication No. 2012-241241, a titanium material is strengthened only by dissolving oxygen atoms as a solute of solid solution; however, from the viewpoint of applying the titanium material to various purposes of use, it is desired that an improvement in the characteristics is exhibited by incorporation of other metal atoms or compounds in addition to solid solution strengthening by oxygen atoms.

An object of the present invention is to provide a high-strength titanium sintered compact and a method for producing the same that can achieve an improvement in the characteristics by incorporating other metals or compounds into a matrix in addition to solid solution strengthening by oxygen atoms.

Solution to Problem

In one aspect, an oxygen solid solution titanium sintered compact according to the present invention includes a matrix made of a titanium component having an α-phase, oxygen atoms dissolved as a solute of solid solution in a crystal lattice of the titanium component, and metal atoms dissolved as a solute of solid solution in the crystal lattice of the titanium component.

In one embodiment, a compound of the titanium component and the metal atoms exceeding a solid solubility limit of dissolving into the α-phase is dispersed in the matrix.

In another aspect, an oxygen solid solution titanium sintered compact according to the present invention includes a matrix made of a titanium component having an α-phase, oxygen atoms dissolved as a solute of solid solution in a crystal lattice of the titanium component, and a metal component that is present by being dispersed in the matrix.

In one embodiment, the metal component is made of metal atoms that are deposited in the matrix. In another embodiment, the metal component is a compound of metal atoms and the titanium component.

A metal of the metal atoms or metal component is a metal selected, for example, from the group consisting of Si, Ta, Cu, Nb, Co, Fe, Mn, V, Sn, Cr, Al, Be, Zr, and Mg.

A method for producing an oxygen solid solution titanium sintered compact according to the present invention includes a step of mixing a titanium component powder made of a titanium component having an α-phase with oxide particles of a metal other than titanium, a step of applying a compression force to shape a mixed powder obtained through the mixing, and a step of heating and sintering a compressed shaped compact, which is obtained through the compression shaping, in a solid-phase temperature region of an atmosphere that does not contain oxygen. The sintering step includes decomposing the metal oxide into metal atoms and oxygen atoms, dissolving the oxygen atoms, which have been dissociated from the metal oxide, as a solute of solid solution into a crystal lattice of the titanium component, and allowing the metal atoms, which have been dissociated from the metal oxide, to remain in a matrix of the titanium component.

The oxide particles are, for example, oxide particles of a metal selected from the group consisting of Si, Ta, Cu, Nb, Co, Fe, Mn, V, Sn, Cr, Al, Be, Zr, and Mg.

Preferably, a lower limit of a heating and sintering temperature of the solid-phase temperature region is 700° C., and an upper limit of the heating and sintering temperature is a lower one of a temperature equal to or lower than a boiling point of the metal constituting the metal oxide and a temperature equal to or lower than a melting point of the titanium component.

The metal atoms dissociated from the metal oxide are dissolved as a solute of solid solution into the crystal lattice of the titanium component by a treatment of the heating and sintering. Alternatively, the metal atoms dissociated from the metal oxide react with the titanium component by a treatment of the heating and sintering to form a compound to be dispersed in the matrix. Alternatively, the metal atoms dissociated from the metal oxide are deposited in the matrix of the titanium component by a treatment of the heating and sintering.

In one embodiment, the compression shaping step and the sintering step are simultaneously carried out. Preferably, the method for producing an oxygen solid solution titanium sintered compact further includes a step of performing a homogenizing heat treatment on the sintered compact obtained after the heating and sintering. Also, preferably, the method for producing an oxygen solid solution titanium sintered compact further includes a step of performing plastic forming of the sintered compact obtained after the heating and sintering.

Advantageous Effects of Invention

According to the present invention, a high-strength titanium sintered compact can be obtained by solid solution strengthening of oxygen atoms dissociated from the metal oxide and solid solution strengthening, deposition strengthening, or dispersion strengthening of metal atoms dissociated from the metal oxide.

DESCRIPTION OF EMBODIMENTS

[Binary Phase Diagram of Ti—O]

Figure 1:
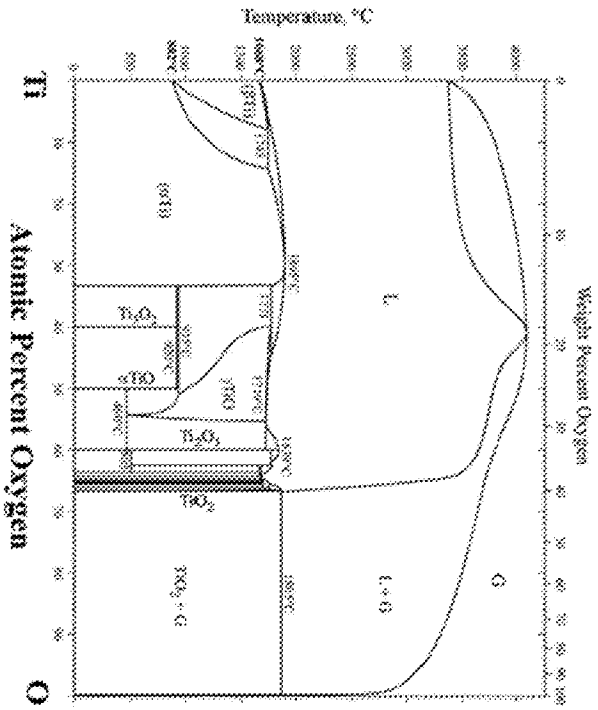
FIG. 1 is a binary phase diagram of titanium and oxygen.

FIG. 1 shows a binary phase diagram of titanium and oxygen. As will be clear from FIG. 1, an α-Ti crystal can dissolve oxygen as a solute of solid solution up to 33 atom % at the maximum. The reason why such a large amount of oxygen can be dissolved as a solute of solid solution is that the α-Ti crystal has a hexagonal close-packed structure (hcp). Titanium is the only element that can dissolve a large amount of oxygen as a solute of solid solution, and this characteristic feature cannot be seen in the other metals.

However, when a titanium material is fabricated by the melting method, it is not possible to dissolve a large amount of oxygen as a solute of solid solution. This is because, in a liquid phase state, a crystal lattice is not formed, and titanium takes up oxygen only when titanium is brought into a solid phase state to form a crystal lattice having the hexagonal close-packed structure.

[Standard Free Energy of Formation of Oxide—Temperature Diagram]

Accordingly, the inventor of the present application has made a study on whether a reaction between titanium and a metal oxide can be used or not as a technique for incorporating oxygen atoms into a matrix of titanium in a solid phase state.

Figure 2:
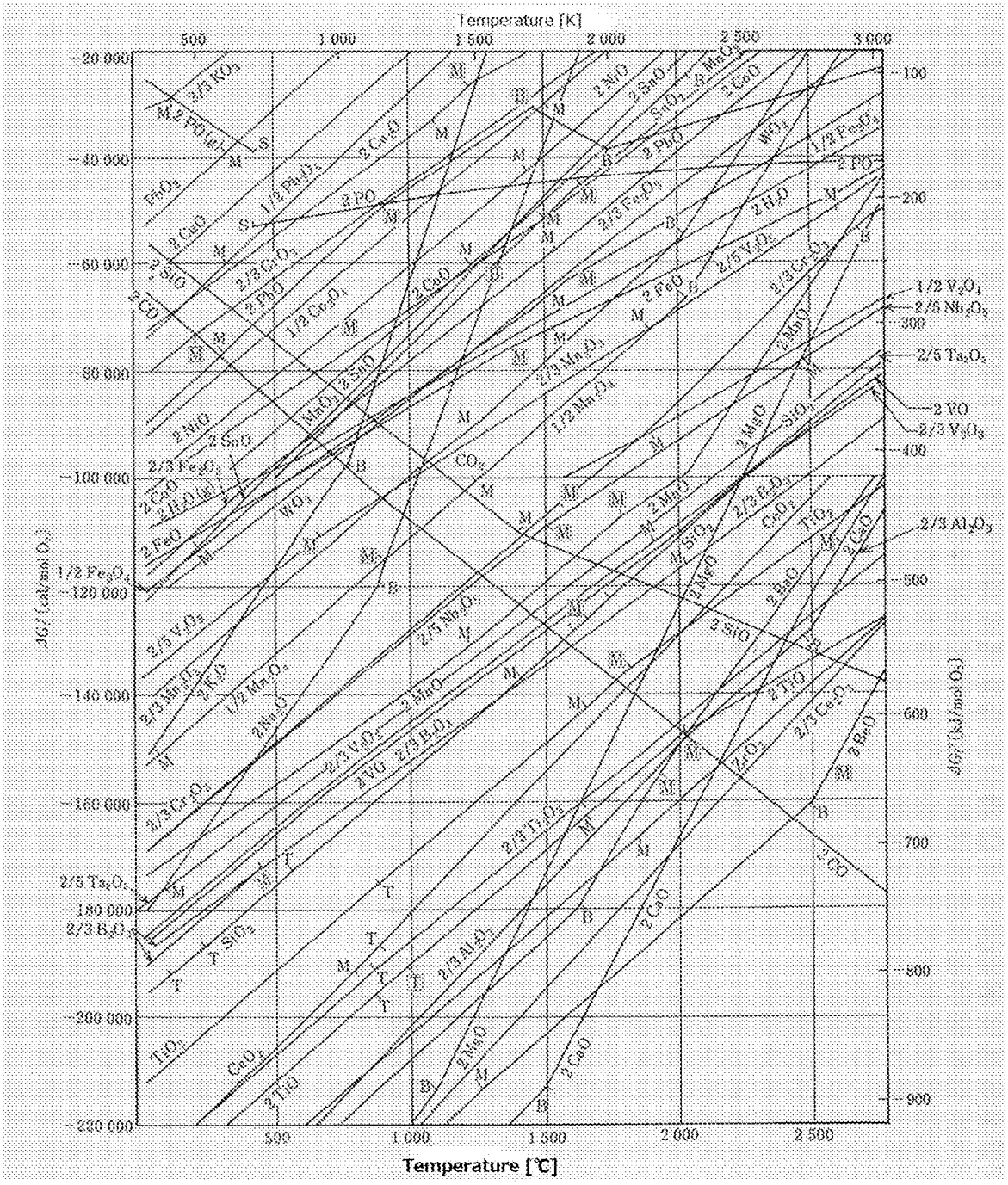
FIG. 2 is a view showing a relationship between the standard free energy of formation of oxide and temperature.

FIG. 2 is a diagram showing a relationship between the standard free energy of formation of oxide and the temperature. The source of this diagram is "Metal Data Book, revised 3rd edition" (Editor: Corporate Juridical Person of The Japan Institute of Metals and Materials) published by Maruzen Publishing Co., Ltd. In the graph of FIG. 2, a metal oxide whose standard free energy of formation on the longitudinal axis is positioned below (that is, having a lower energy) in a specific temperature region shown on the lateral axis has a higher stability than a metal oxide whose standard free energy of formation is positioned above (that is, having a higher energy). Therefore, according to the principle of thermodynamics, it can be expected that a metal ML whose standard free energy of formation is positioned below in a specific temperature region exhibits a reduction function on an oxide of a metal MU whose standard free energy of formation is positioned above, whereby the metal ML decomposes the oxide of the metal MU and takes up the dissociated oxygen atoms.

In order to verify this expectation, the inventor of the present application has conducted an experiment of sintering a mixed powder of titanium powder and oxide particles of a metal MU whose standard free energy of formation is higher than that of titanium (Ti) in the graph of FIG. 2, in a solid phase state (below the melting point of titanium). As a result of this, it has been confirmed that the oxide of the metal MU is decomposed; the dissociated oxygen atoms are dissolved as a solute of solid solution in the crystal lattice of titanium; and moreover, the dissociated atoms of the metal MU are dissolved as a solute of solid solution in the crystal lattice of titanium, deposited in a matrix of titanium, or dispersed in the matrix of titanium by forming a compound with titanium.

Further, the inventor of the present application has found out a phenomenon such that even an oxide of a metal ML whose standard free energy of formation is positioned below that of titanium oxide is decomposed by reacting with titanium at the time of sintering in the solid phase state, thereby to dissociate oxygen atoms and metal atoms. It has been confirmed that the dissociated oxygen atoms are dissolved as a solute of solid solution in the crystal lattice of titanium; and moreover, the dissociated atoms of the metal ML are dissolved as a solute of solid solution in the crystal lattice of titanium, deposited in the matrix of titanium, or dispersed in the matrix of titanium by forming a compound with titanium. Such a behavior is against the principle of thermodynamics and is a phenomenon that is seen only in a sintering process in a solid-phase temperature region using a titanium powder.

[Magnesium Having Hexagonal Close-Packed Structure]

Magnesium (Mg) has a hexagonal close-packed structure in the same manner as titanium; however, the amount of oxygen that can be dissolved as a solute of solid solution is extremely small. For this reason, even when a mixed powder of a magnesium powder and oxide particles of another metal is sintered, chemical reaction does not occur between the two.

Figure 3:
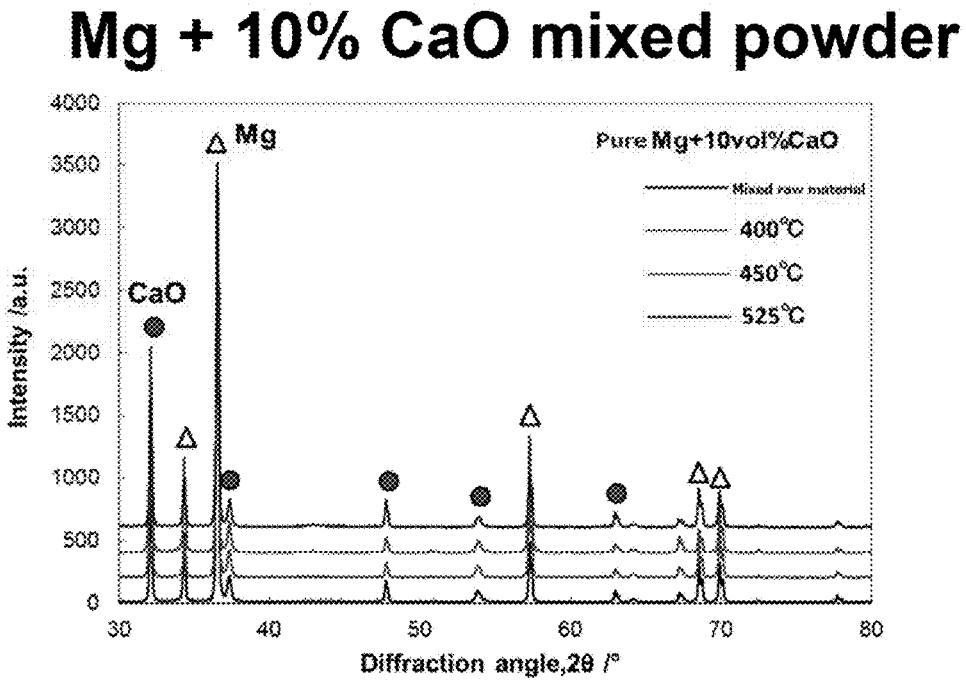
FIG. 3 is a view showing an X-ray diffraction result of Mg+10 vol % CaO-based mixed powder and sintered compact.

The inventor of the present application has conducted an experiment of mixing a magnesium powder with particles of calcium oxide (CaO), which is an oxide more stable than magnesium oxide (MgO), and heating the obtained mixture within a range of 400° C. to 525° C., so as to confirm whether the two undergo a chemical reaction. The amount of the magnesium oxide particles relative to the total mixed powder was 10 vol %. FIG. 3 shows an X-ray diffraction result of this experiment. In FIG. 3, the four lines represent the lines of the mixed raw material, 400° C.-sintered, 450° C.-sintered, and 525° C.-sintered, respectively, in the order from below.

The peak of CaO shown by the symbol "•" remains as it is without disappearing even when the mixture is subjected to the heating treatment, and a shift of the peak position of Mg shown by the symbol "Δ" is not generated, either. What can be read out from this FIG. 3 is that magnesium and calcium oxide do not undergo a chemical reaction even under heating, and the calcium oxide is not decomposed.

It has been confirmed that magnesium does not generate a chemical reaction or an oxygen solid solution forming phenomenon such as seen in titanium because the amount of oxygen that can be dissolved as a solute of solid solution in magnesium is small, though magnesium has a hexagonal close-packed structure similar to that of titanium.

[Mixed Powder of Titanium Powder and Metal Oxide Particles Used in the Experiment]

A material of the titanium powder used in the experiment was pure titanium. Pure titanium can dissolve a large amount of oxygen atoms and the like as a solute of solid solution because of having an α phase (crystal lattice of the hexagonal close-packed structure). Although not used in the experiment of this time, even a titanium alloy powder having an α phase, when used instead of pure titanium powder, can dissolve a large amount of oxygen atoms and the like as a solute of solid solution in the same manner as pure titanium. As an example of a titanium alloy having an α phase, Ti-6% Al-4% V, Ti—Al—Fe-based titanium alloy, Ti—Al—Fe—Si-based titanium alloy, and the like can be mentioned.

An average particle size of the pure titanium powder used in the experiment was 28 μm; however, those having a particle size up to about 10 μm to 150 μm may likewise be used.

As a metal that forms the metal oxide, it is possible to use Si, Ta, Cu, Nb, Co, Fe, Mn, V, Sn, Cr, Al, Be, Zr, Mg, and the like. As oxides of these metals, metal oxides having a standard free energy of formation higher than $TiO_2$ (that is, being thermodynamically more unstable than $TiO_2$) in a temperature range of solid phase sintering are $SiO_2$, $Ta_2O_5$, CuO, $Cu_2O$, $Nb_2O_5$, $CoO_2$, FeO, MnO, $V_2O_3$, SnO, and $Cr_2O_3$. On the other hand, metal oxides having a standard free energy of formation lower than $TiO_2$ (that is, being thermodynamically more stable than $TiO_2$) in the temperature range of solid phase sintering are $\alpha$-$Al_2O_3$, $\beta$-$Al_2O_3$, BeO, $ZrO_2$, and MgO.

An average particle size of the metal oxide particles is about 1 μm to 10 μm. A surface of the titanium component powder particles is preferably coated with an oil having an adhesive property in advance in order that the metal oxide particles may be dispersed on the titanium component powder particles without being aggregated at the time of mixing.

[Method for Producing Sintered Compact]

(1) Mixing Step

A pure titanium powder having an average particle size of 28 μm and various kinds of metal oxide particles were mixed under a dry condition with use of a ball mill. The amount of the metal oxide particles is preferably set to be within a range of 0.1% to 7% in terms of mass with respect to the total mixed powder. When the amount of the metal oxide particles is less than 0.1%, the effect of metal oxide particle addition is not fully exhibited. On the other hand, when the amount of the metal oxide particles exceeds 7%, the titanium material sintered compact tends to be brittle because of becoming excessively hard.

The mixing treatment conditions in conducting the experiment with use of the ball mill are as follows.

Dry Mixing Treatment Using a Ball Mill

Rotation number: 90 rpm

Mixing time: 1 H

Amount of metal oxide relative to the total mixed powder: 5 mass %

(2) Shaping Step

A compression force was applied to shape the mixed powder obtained by the mixing treatment described above. This compression shaping may be carried out separately from the sintering step or may be carried out simultaneously with the sintering treatment.

When the compression shaping is carried out before the sintering treatment, the compression shaping may be carried out either under a cold condition or under a hot condition. Since a mold made of steel can be used as the shaping mold, the shaping pressure can be set to be about 300 to 800 MPa.

In a spark plasma sintering treatment in which the compression shaping and the solid-phase sintering are simultaneously carried out, a mold made of carbon is used as the shaping mold, so that the shaping pressure must be set to be about 100 MPa or less in view of the strength of the mold.

(3) Sintering Step

In the experiment, the spark plasma sintering treatment was carried out while shaping the mixed powder by applying a pressurizing force of 30 MPa to the mixed powder. The conditions of a spark plasma sintering treatment apparatus were as follows.

Sintering temperature: 1000° C. (solid-phase temperature region)

Holding time: 1 H

Atmosphere: vacuum (4 Pa or less)

A lower limit of the sintering temperature is about 700° C. at which the metal oxide is decomposed. An upper limit of the sintering temperature is the lower one of a temperature equal to or lower than the melting point of the titanium component and a temperature equal to or lower than the boiling point of the metal constituting the metal oxide.

When the sintering step is carried out separately from the compression shaping step, the atmosphere during the sintering need not be set to be a vacuum atmosphere, so that the atmosphere during the sintering may be an inert gas atmosphere that does not contain oxygen.

During the sintering treatment described above, the metal oxide is decomposed into oxygen atoms and metal atoms. The dissociated oxygen atoms are dissolved as a solute of solid solution into the crystal lattice of the hexagonal close-packed structure of the titanium component. The dissociated metal atoms perform one of the following behaviors depending on the type of the metal.

a) The dissociated metal atoms are dissolved as a solute of solid solution into the crystal lattice of the hexagonal close-packed structure of the titanium component.

b) The dissociated metal atoms are deposited in the matrix of the titanium component. The deposition is either within the crystal and/or on the crystal grain boundary.

c) The dissociated metal atoms react with the titanium component to be dispersed in the matrix of the titanium component. The dispersion is either within the crystal and/or on the crystal grain boundary.

(4) Homogenizing Heat Treatment Step

A heat treatment for homogenizing the structure of the sintered compact obtained after the heating and sintering was carried out.

(5) Hot Plastic Forming Step

The sintered compact subjected to the homogenizing heat treatment was subjected to hot extrusion forming. The hot extrusion forming is one type of the plastic forming; however, hot forging forming or hot rolling forming may be carried out in place of the hot extrusion forming. By subjecting the sintered compact to the hot plastic forming, the strength of the oxygen solid solution titanium sintered compact can be further improved. The samples of the tensile test described later were obtained by subjecting the sintered compact to hot extrusion forming.

[Evaluation on the Characteristics of Sintered Compact]

The inventor of the present application has confirmed through the following evaluation that, by mixing a powder made of a titanium component with oxide particles of a metal other than titanium and pressure-sintering the obtained mixture, the oxygen atoms and the metal atoms dissociated from the metal oxide are dissolved as a solute of solid solution, deposited, or dispersed in the titanium material, that the hardness of the sintered compact is increased, and further that the tensile strength of the extruded material of the sintered compact is increased.

a) X-ray diffraction of raw material mixed powder (before sintering) and sintered compact b) Structure micrograph of sintered compact c) Measurement of micro Vickers hardness (Hv) of sintered compact d) Tensile test of sintered compact extruded material at ordinary temperature

[Confirmation on Decomposition of Metal Oxide and Behavior of Dissociated Oxygen Atoms and Metal Atoms]

FIGS. 4 to 19 are diagrams showing an X-ray diffraction result, where the line located at the lowermost position represents the mixed powder of pure titanium and metal oxide particles (before sintering); the line located at the uppermost position represents the metal oxide particles; and the line located at the middle position represents the sintered compact after the spark plasma sintering treatment. In each diagram, the symbol "○" indicates a peak showing the presence of metal oxide; the symbol "Δ" indicates a peak showing pure titanium; the symbol "◆" indicates a peak showing the compound of titanium and the metal; and the symbol "◇" indicates a peak showing the metal component.

(1) Ti+5 Mass % $SiO_2$

Figure 4:
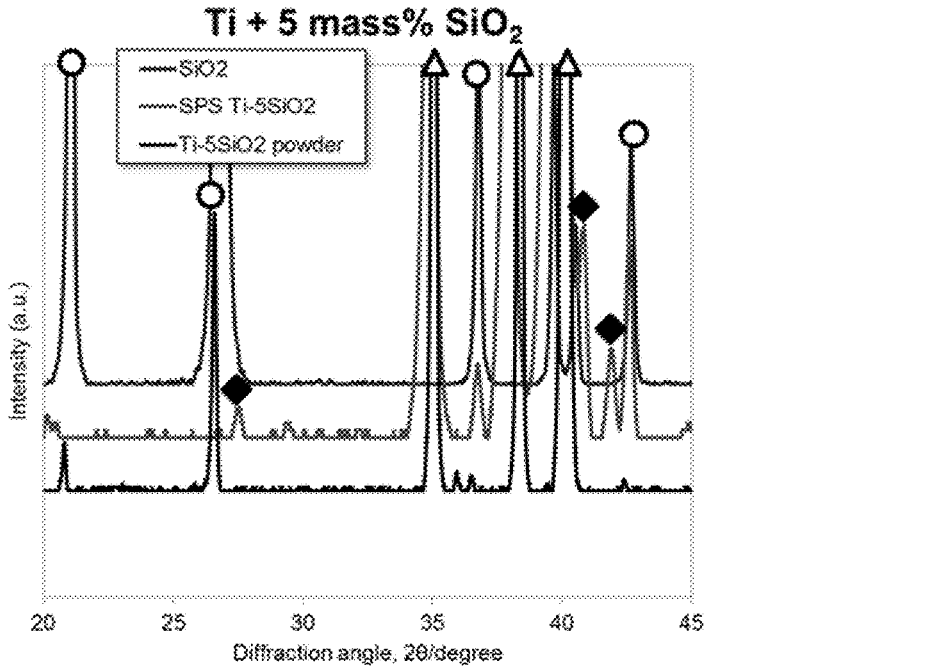
FIG. 4 is a view showing an X-ray diffraction result of Ti+5 mass % $SiO_2$-based mixed powder and sintered compact.

Reference is made to the mixed powder of Ti+5 mass % $SiO_2$ shown in FIG. 4. In the $SiO_2$ particles (the line located at the uppermost position), the peak "○" of $SiO_2$ appears at the diffraction angles near 21 degrees and near 27 degrees. In the mixed powder (the line located at the lowermost position), the peak of $SiO_2$ appears, and also the peak "Δ" of pure titanium appears at the diffraction angles near 35 degrees, near 38 degrees, and near 40 degrees.

When attention is paid to the sintered compact (the line located at the middle position), it is found out that the peaks of $SiO_2$ at the diffraction angles near 21 degrees and near 27 degrees have disappeared. This means that $SiO_2$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and silicon atoms dissociated by decomposition of the silicon oxide are dissolved as a solute of solid solution in the crystal lattice of the hexagonal close-packed structure of titanium.

When further attention is paid to the sintered compact, it is found out that a peak of a compound of titanium and silicon (Ti—Si-based compound) newly appears. This means that the silicon atoms dissociated by decomposition of the silicon oxide have reacted with titanium to form the Ti—Si-based compound to be dispersed in the matrix of titanium.

Figure 20:
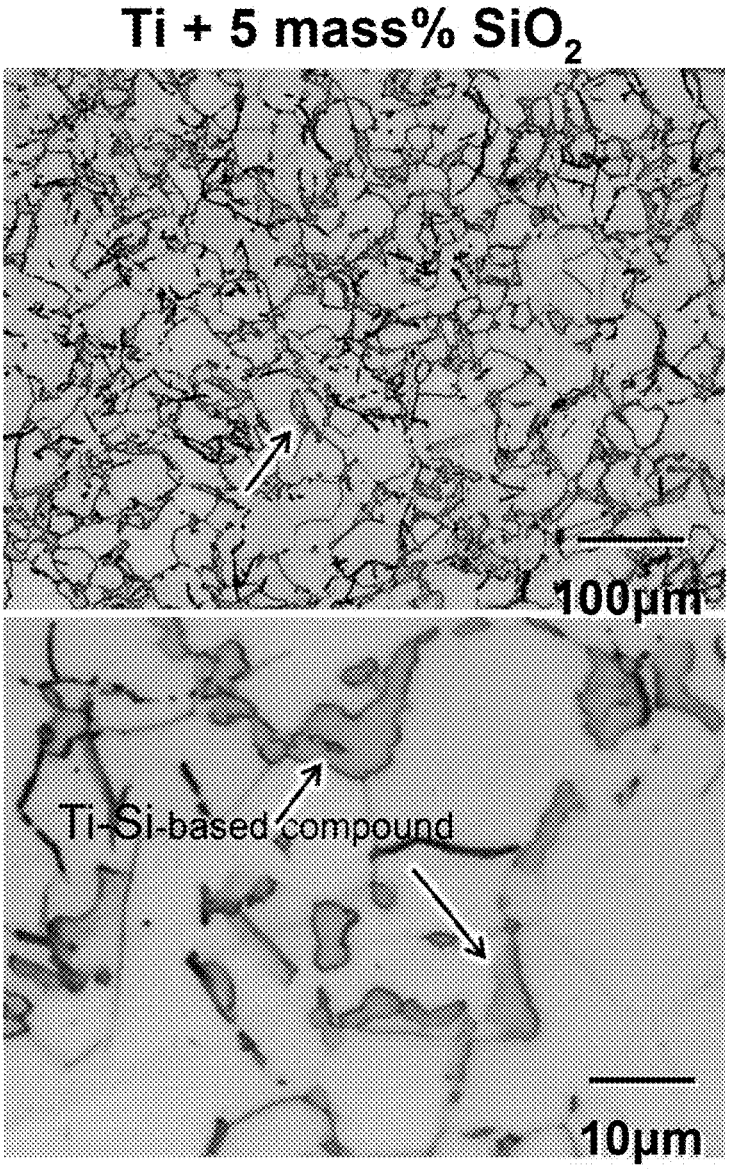
FIG. 20 is a structure micrograph of Ti+5 mass % $SiO_2$-based mixed powder sintered compact.

When the structure micrograph of FIG. 20 is seen, it can be confirmed that the Ti—Si-based compound is dispersed in the matrix of titanium.

(2) Ti+5 Mass % $Ta_2O_5$

Figure 5:
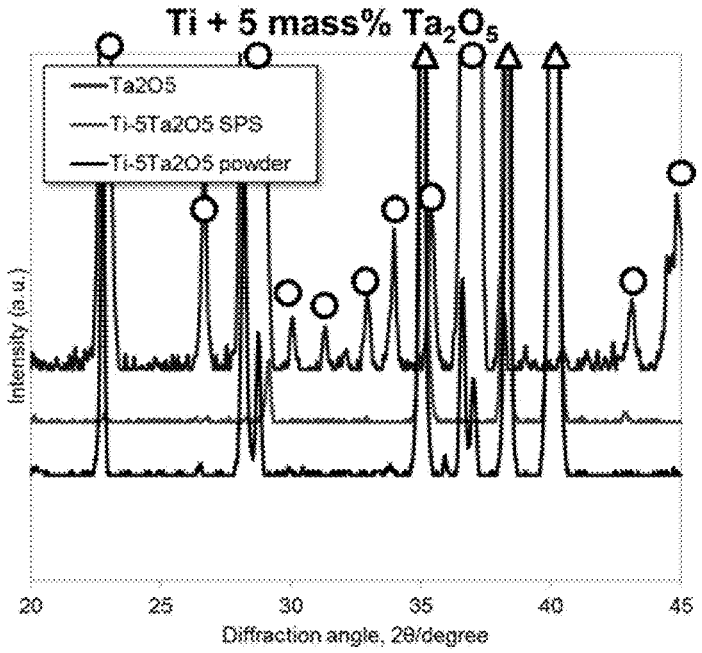
FIG. 5 is a view showing an X-ray diffraction result of Ti+5 mass % $Ta_2O_5$-based mixed powder and sintered compact.

Reference is made to the mixed powder of Ti+5 mass % $Ta_2O_5$ shown in FIG. 5. In the $Ta_2O_5$ particles (the line located at the uppermost position), the peak "○" of $Ta_2O_5$ appears, for example, at the diffraction angles near 23 degrees and near 27 degrees. In the mixed powder (the line located at the lowermost position), the peak of $Ta_2O_5$ appears, and also the peak "Δ" of pure titanium appears at the diffraction angles near 35 degrees, near 38 degrees, and near 40 degrees.

When attention is paid to the sintered compact (the line located at the middle position), it is found out that the peaks of $Ta_2O_5$ at the diffraction angles near 23 degrees and near 27 degrees have disappeared. This means that $Ta_2O_5$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted a little toward one angle side as compared with that before the sintering. This is because the oxygen atoms and tantalum atoms dissociated by decomposition of the tantalum oxide are dissolved as a solute of solid solution in the crystal lattice of the hexagonal close-packed structure of titanium.

When further attention is paid to the sintered compact, it is found out that neither a peak of a compound of titanium and tantalum (Ti—Ta-based compound) nor a peak of tantalum appears. This means that all of the tantalum atoms dissociated by decomposition of tantalum oxide are dissolved as a solute of solid solution in the crystal lattice of the hexagonal close-packed structure of titanium.

Figure 21:
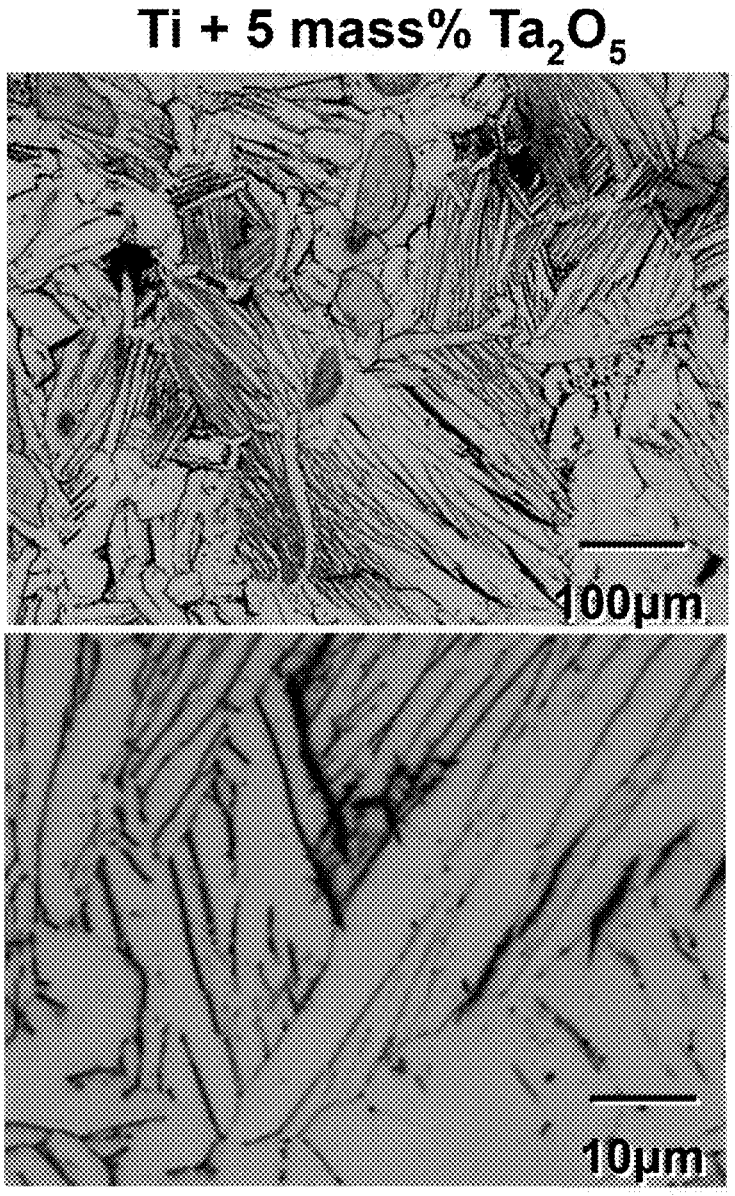
FIG. 21 is a structure micrograph of Ti+5 mass % $Ta_2O_5$-based mixed powder sintered compact.

When the structure micrograph of FIG. 21 is seen, it can be confirmed that neither the Ti—Ta-based compound nor the Ta component appears in the matrix.

(3) Ti+5 Mass % $\alpha Al_2O_3$

Figure 6:
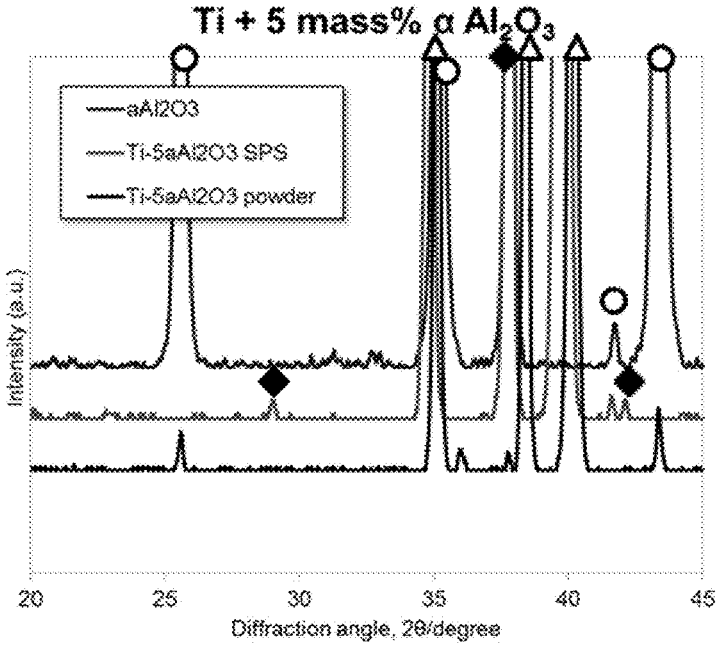
FIG. 6 is a view showing an X-ray diffraction result of Ti+5 mass % $\alpha Al_2O_3$-based mixed powder and sintered compacts.

Reference is made to the mixed powder of Ti+5 mass % $\alpha Al_2O_3$ shown in FIG. 6. In the $\alpha Al_2O_3$ particles (the line located at the uppermost position), the peak "○" of $\alpha Al_2O_3$ appears, for example, at the diffraction angles near 25 degrees and near 43 degrees. In the mixed powder (the line located at the lowermost position), the peak of $\alpha Al_2O_3$ appears, and also the peak "Δ" of pure titanium appears at the diffraction angles near 35 degrees, near 38 degrees, and near 40 degrees.

When attention is paid to the sintered compact (the line located at the middle position), it is found out that the peaks of $\alpha Al_2O_3$ at the diffraction angles near 25 degrees and near 43 degrees have disappeared. This means that $\alpha Al_2O_3$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and aluminum atoms dissociated by decomposition of the aluminum oxide are dissolved as a solute of solid solution in the crystal lattice of the hexagonal close-packed structure of titanium.

When further attention is paid to the sintered compact, it is found out that a peak of a compound of titanium and aluminum (Ti—Al-based compound) newly appears. This means that the aluminum atoms dissociated by decomposition of the aluminum oxide have reacted with titanium to form the Ti—Al-based compound to be dispersed in the matrix of titanium.

Figure 22:
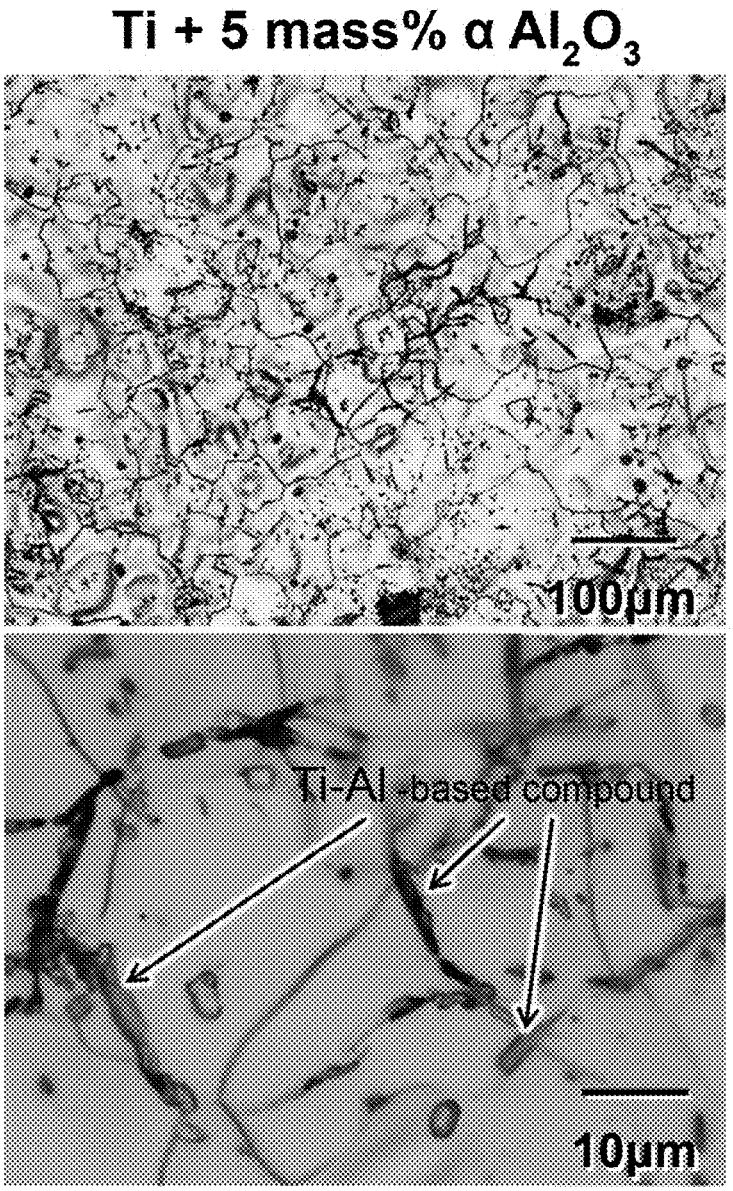
FIG. 22 is a structure micrograph of Ti+5 mass % $\alpha Al_2O_3$-based mixed powder sintered compact.

When the structure micrograph of FIG. 22 is seen, it can be confirmed that the Ti—Al-based compound is dispersed in the matrix of titanium.

(4) Ti+5 Mass % $\gamma Al_2O_3$

Figure 7:
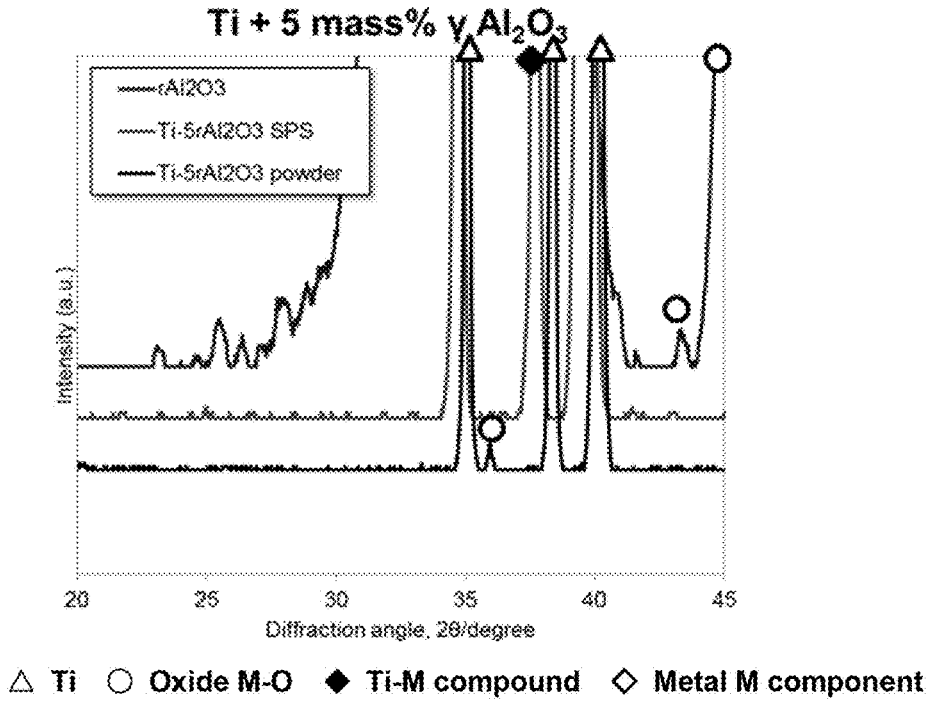
FIG. 7 is a view showing an X-ray diffraction result of Ti+5 mass % $\gamma Al_2O_3$-based mixed powder and sintered compacts.

Reference is made to the mixed powder of Ti+5 mass % $\gamma Al_2O_3$ shown in FIG. 7. In the $\gamma Al_2O_3$ particles (the line located at the uppermost position), the peak "○" of $\gamma Al_2O_3$ appears, for example, at the diffraction angle near 36 degrees. In the mixed powder (the line located at the lowermost position) also, the peak "○" of $\gamma Al_2O_3$ appears at the diffraction angle near 36 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $\gamma Al_2O_3$ at the diffraction angle near 36 degrees has disappeared. This means that $\gamma Al_2O_3$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and aluminum atoms dissociated by decomposition of the aluminum oxide are dissolved as a solute of solid solution in the crystal lattice of the hexagonal close-packed structure of titanium.

When further attention is paid to the sintered compact, it is found out that a peak of a compound of titanium and aluminum (Ti—Al-based compound) newly appears at the diffraction angle near 37 degrees. This means that the aluminum atoms dissociated by decomposition of the aluminum oxide have reacted with titanium to form the Ti—Al-based compound to be dispersed in the matrix of titanium.

Figure 23:
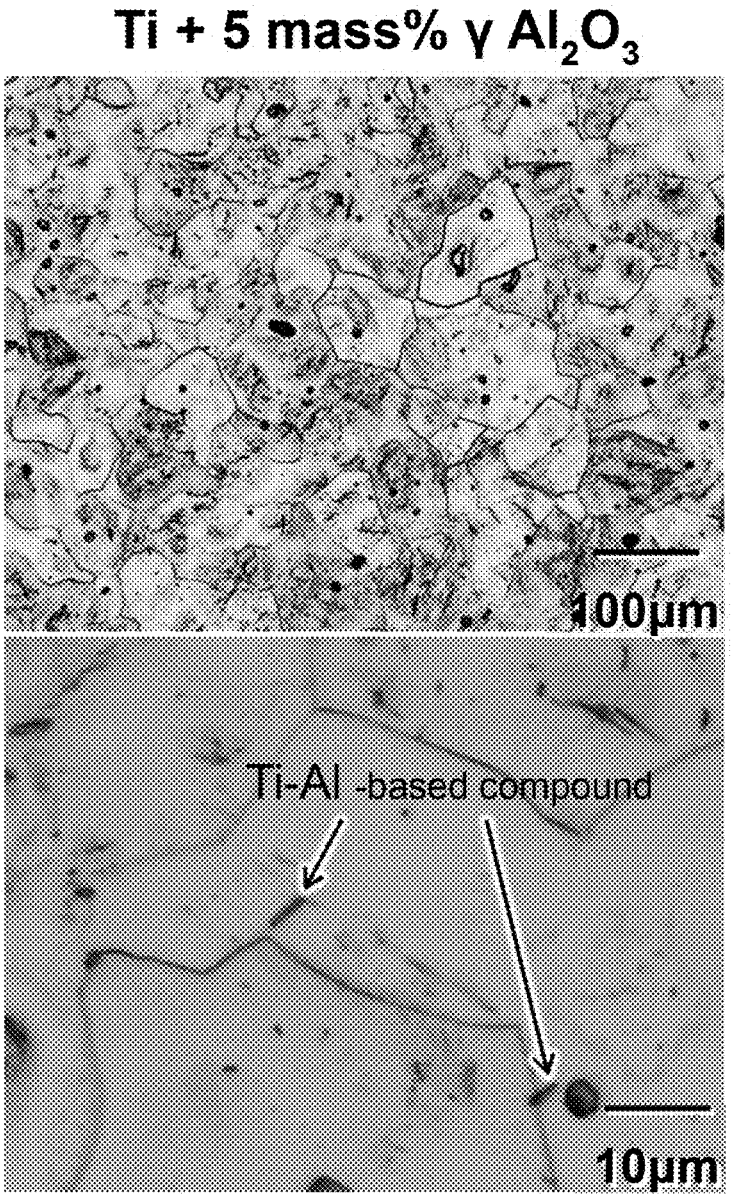
FIG. 23 is a structure micrograph of Ti+5 mass % $\gamma Al_2O_3$-based mixed powder sintered compact.

When the structure micrograph of FIG. 23 is seen, it can be confirmed that the Ti—Al-based compound is dispersed in the matrix of titanium.

(5) Ti+5 Mass % CuO

Figure 8:
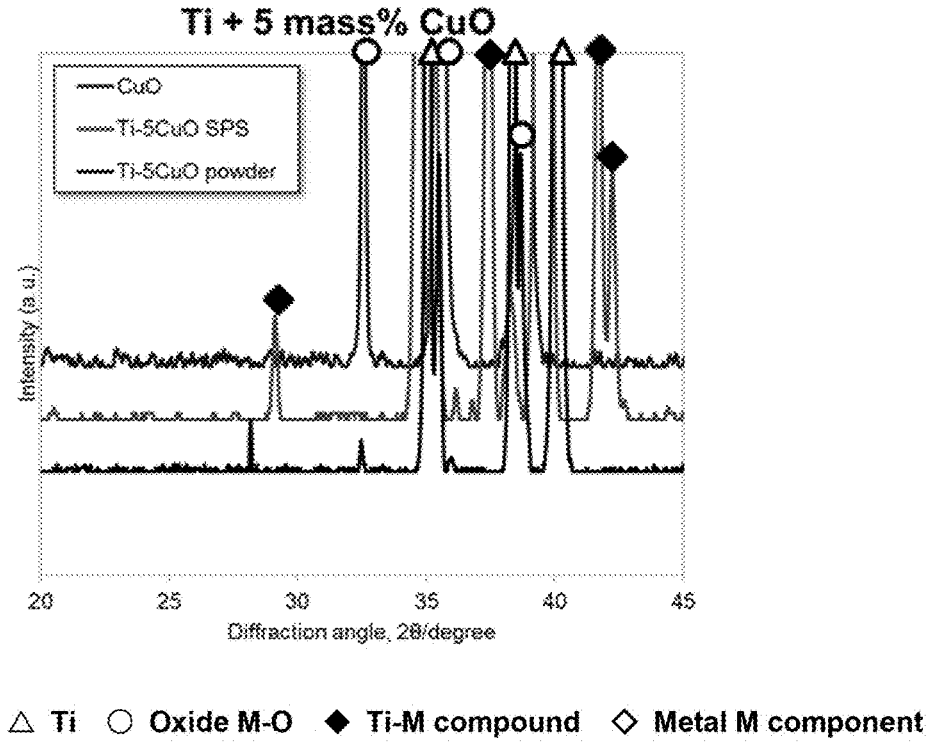
FIG. 8 is a view showing an X-ray diffraction result of Ti+5 mass % CuO-based mixed powder and sintered compacts.

Reference is made to the mixed powder of Ti+5 mass % CuO shown in FIG. 8. In the CuO particles (the line located at the uppermost position), the peak "○" of CuO appears, for example, at the diffraction angle near 33 degrees. In the mixed powder (the line located at the lowermost position) also, the peak of CuO appears at the diffraction angle near 33 degrees, and also the peak "Δ" of pure titanium appears at the diffraction angles near 35 degrees, near 38 degrees, and near 40 degrees.

When attention is paid to the sintered compact (the line located at the middle position), it is found out that the peak of CuO at the diffraction angle near 33 degrees has disappeared. This means that CuO has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and copper atoms dissociated by decomposition of the copper oxide are dissolved as a solute of solid solution in the crystal lattice of the hexagonal close-packed structure of titanium.

When further attention is paid to the sintered compact, it is found out that a peak of a compound of titanium and copper (Ti—Cu-based compound) newly appears at the diffraction angle near 29 degrees. This means that the copper atoms dissociated by decomposition of the copper oxide have reacted with titanium to form the Ti—Cu-based compound to be dispersed in the matrix of titanium.

Figure 24:
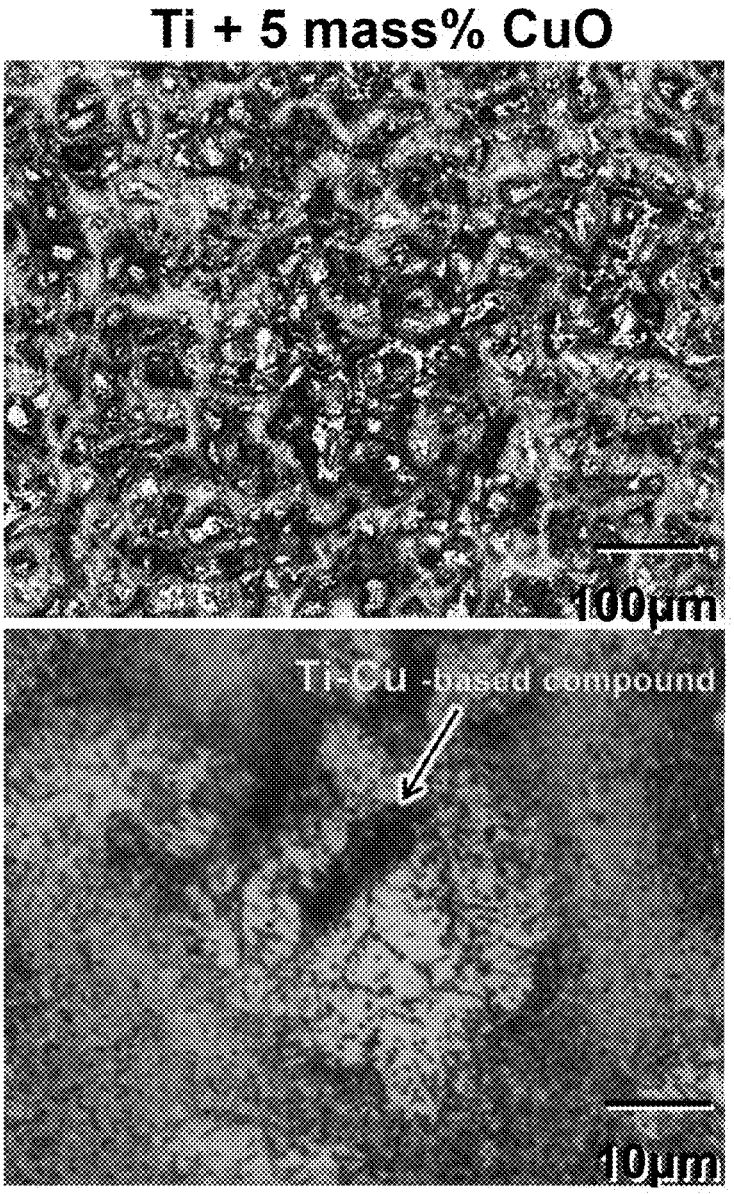
FIG. 24 is a structure micrograph of Ti+5 mass % CuO-based mixed powder sintered compact.

When the structure micrograph of FIG. 24 is seen, it can be confirmed that the Ti—Cu-based compound is dispersed in the matrix of titanium.

(6) Ti+5 Mass % $Cu_2O$

Figure 9:
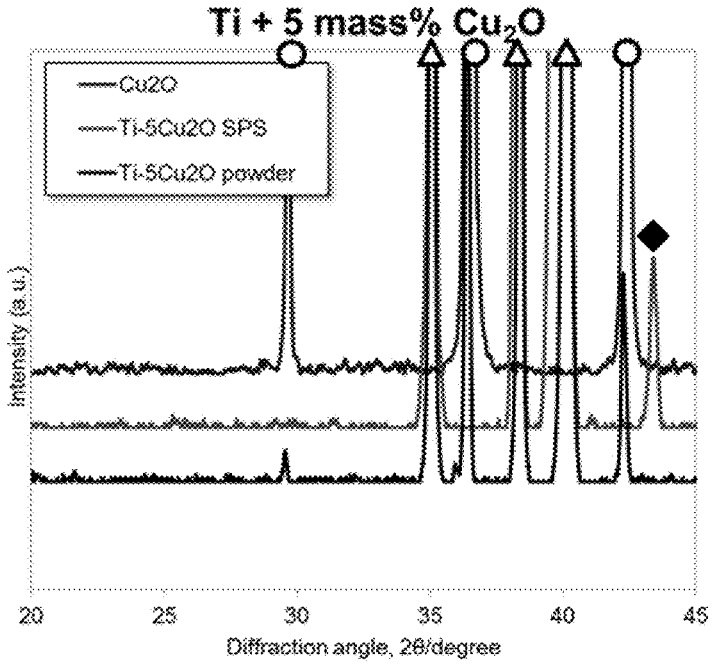
FIG. 9 is a view showing an X-ray diffraction result of Ti+5 mass % $Cu_2O$-based mixed powder and sintered compacts.

Reference is made to the mixed powder of Ti+5 mass % $Cu_2O$ shown in FIG. 9. In the $Cu_2O$ particles (the line located at the uppermost position), the peak "○" of $Cu_2O$ appears, for example, at the diffraction angle near 30 degrees. In the mixed powder (the line located at the lowermost position) also, the peak of $Cu_2O$ appears at the diffraction angle near 30 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $Cu_2O$ at the diffraction angle near 30 degrees has disappeared. This means that $Cu_2O$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and copper atoms dissociated by decomposition of the copper oxide are dissolved as a solute of solid solution in the crystal lattice of the hexagonal close-packed structure of titanium.

When further attention is paid to the sintered compact, it is found out that a peak of a compound of titanium and copper (Ti—Cu-based compound) newly appears at the diffraction angle near 43 degrees. This means that the copper atoms dissociated by decomposition of the copper oxide have reacted with titanium to form the Ti—Cu-based compound to be dispersed in the matrix of titanium.

Figure 25:
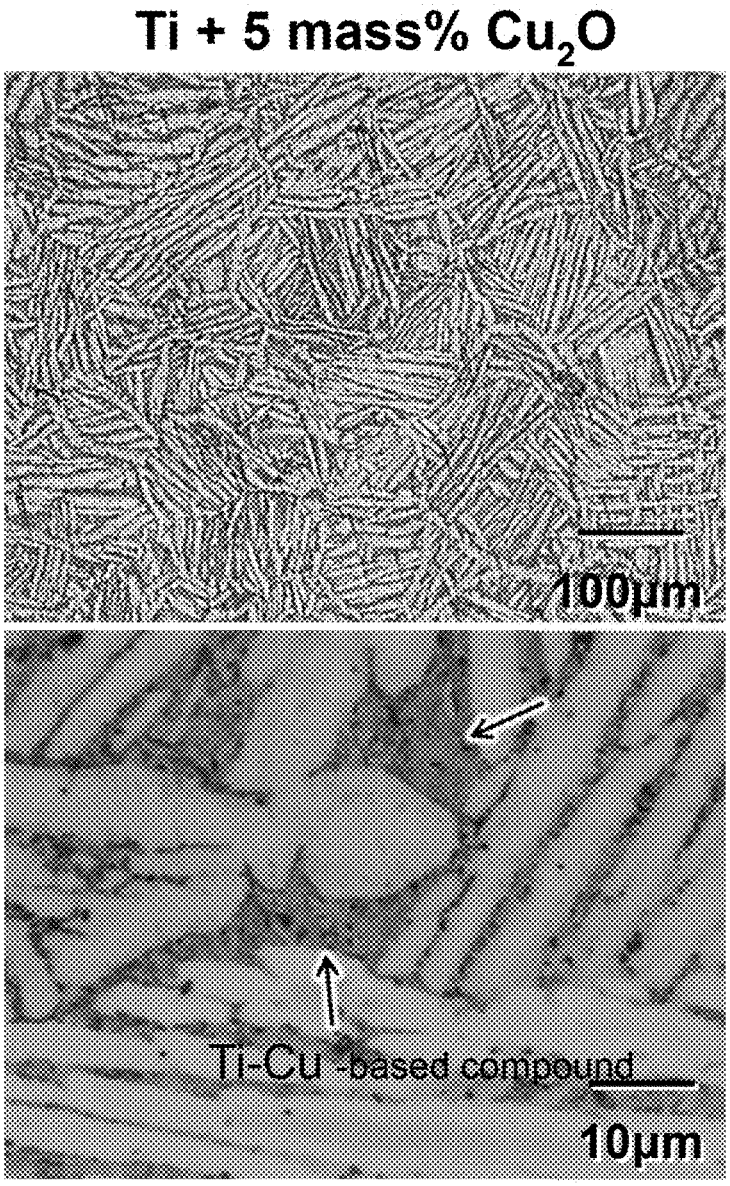
FIG. 25 is a structure micrograph of Ti+5 mass % $Cu_2O$-based mixed powder sintered compact.

When the structure micrograph of FIG. 25 is seen, it can be confirmed that the Ti—Cu-based compound is dispersed in the matrix of titanium.

(7) Ti+5 Mass % $Nb_2O_5$

Figure 10:
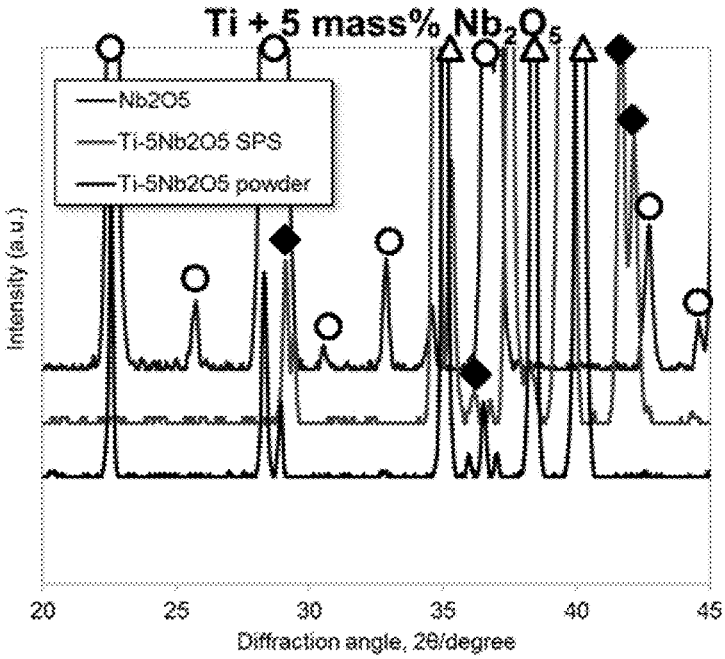
FIG. 10 is a view showing an X-ray diffraction result of Ti+5 mass % $Nb_2O_5$-based mixed powder and sintered compacts.

Reference is made to the mixed powder of Ti+5 mass % $Nb_2O_5$ shown in FIG. 10. In the $Nb_2O_5$ particles (the line located at the uppermost position), the peak "○" of $Nb_2O_5$ appears, for example, at the diffraction angle near 22 degrees. In the mixed powder (the line located at the lowermost position) also, the peak of $Nb_2O_5$ appears at the diffraction angle near 22 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $Nb_2O_5$ at the diffraction angle near 22 degrees has disappeared. This means that $Nb_2O_5$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and niobium atoms dissociated by decomposition of the niobium oxide are dissolved as a solute of solid solution in the crystal lattice of the hexagonal close-packed structure of titanium.

When further attention is paid to the sintered compact, it is found out that a peak of a compound of titanium and niobium (Ti—Nb-based compound) newly appears at the diffraction angle near 29 degrees. This means that the niobium atoms dissociated by decomposition of the niobium oxide have reacted with titanium to form the Ti—Nb-based compound to be dispersed in the matrix of titanium.

Figure 26:
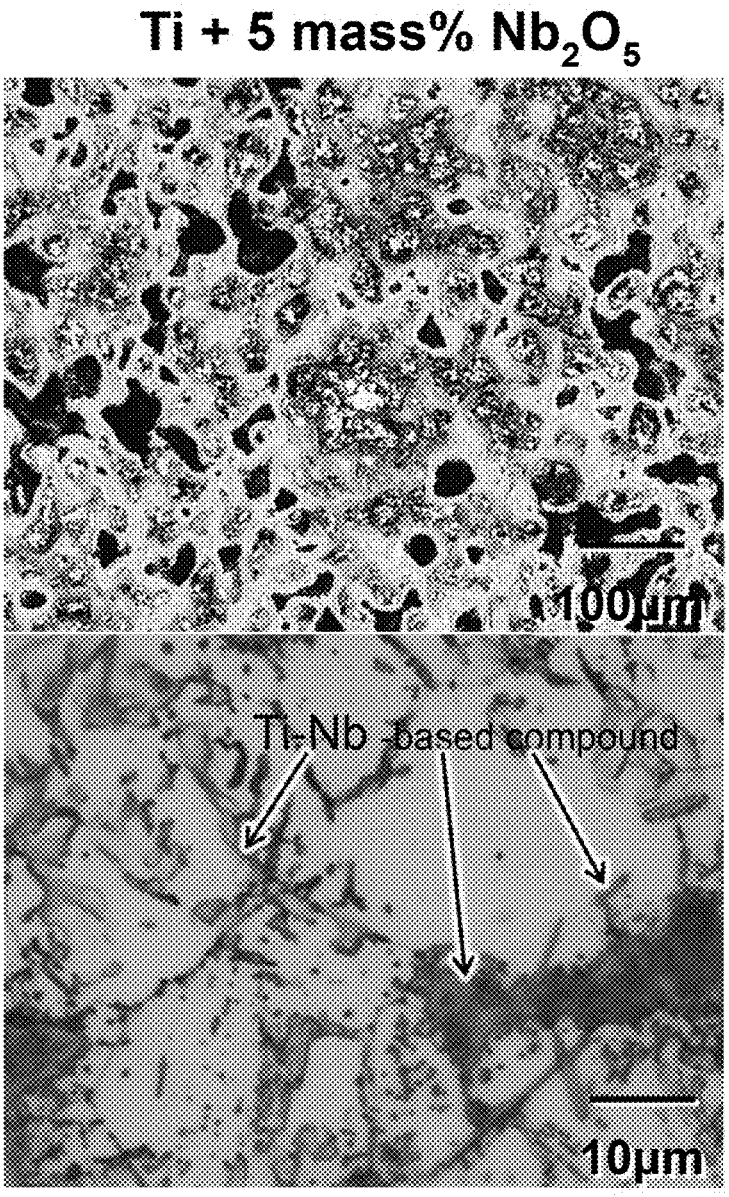
FIG. 26 is a structure micrograph of Ti+5 mass % $Nb_2O_5$-based mixed powder sintered compact.

When the structure micrograph of FIG. 26 is seen, it can be confirmed that the Ti—Nb-based compound is dispersed in the matrix of titanium.

(8) Ti+5 Mass % BeO

Figure 11:
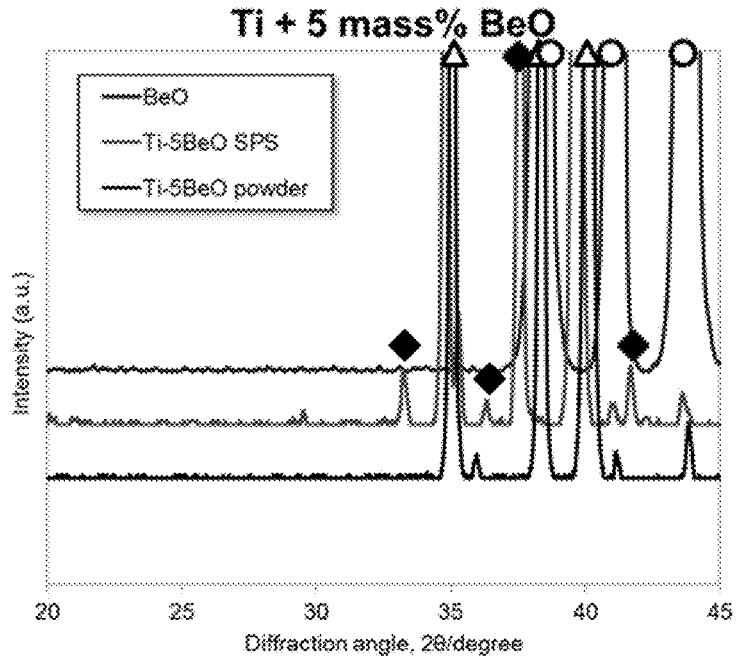
FIG. 11 is a view showing an X-ray diffraction result of Ti+5 mass % BeO-based mixed powder and sintered compacts.

Reference is made to the mixed powder of Ti+5 mass % BeO shown in FIG. 11. In the BeO particles (the line located at the uppermost position), the peak "○" of BeO appears, for example, at the diffraction angle near 44 degrees. In the mixed powder (the line located at the lowermost position) also, the peak of BeO appears at the diffraction angle near 44 degrees, and also the peak "Δ" of pure titanium appears at the diffraction angles near 35 degrees, near 38 degrees, and near 40 degrees.

When attention is paid to the sintered compact (the line located at the middle position), it is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and beryllium atoms dissociated by decomposition of the beryllium oxide are dissolved as a solute of solid solution in the crystal lattice of the hexagonal close-packed structure of titanium.

Here, in the sintered compact, a peak of BeO appears at the diffraction angle near 44 degrees. This shows that, in the experiment of this time, not all of BeO has been decomposed, and non-decomposed BeO still remains. It is possible to decompose all of BeO when a good mixing condition is provided or when the conditions such as the sintering temperature are changed.

When further attention is paid to the sintered compact, it is found out that a peak of a compound of titanium and beryllium (Ti—Be-based compound) newly appears at the diffraction angle near 33 degrees. This means that the beryllium atoms dissociated by decomposition of the beryllium oxide have reacted with titanium to form the Ti—Be-based compound to be dispersed in the matrix of titanium.

Figure 27:
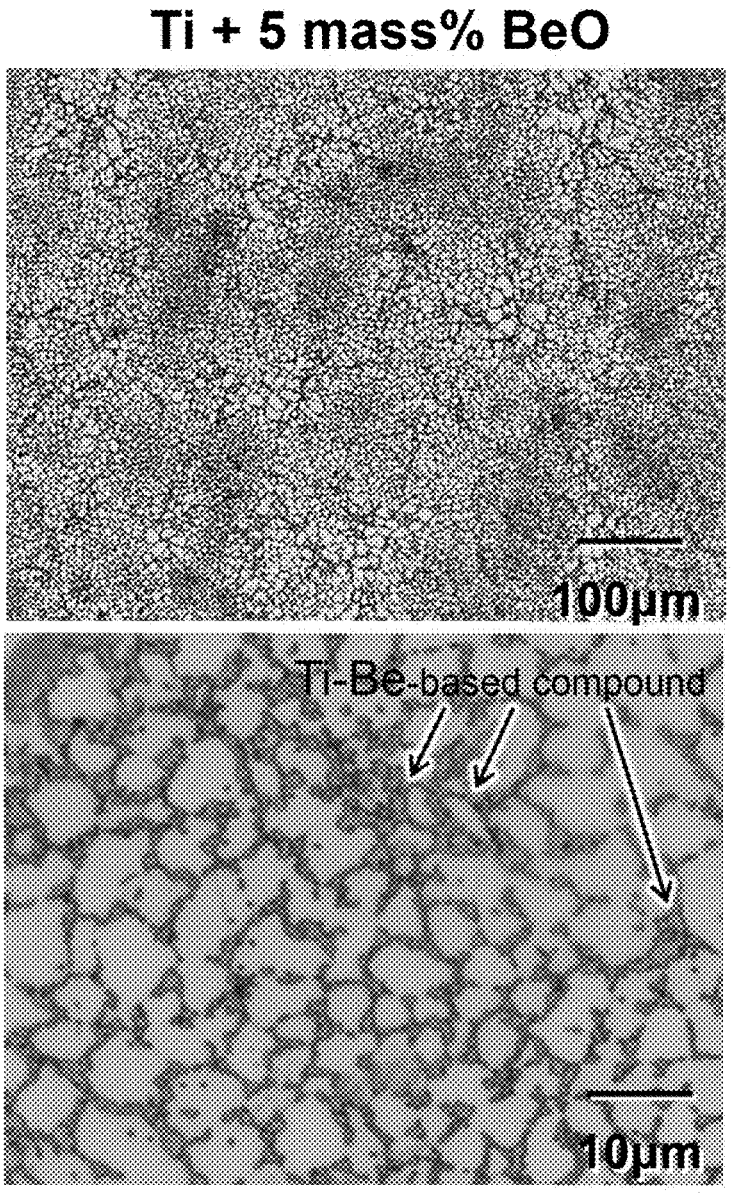
FIG. 27 is a structure micrograph of Ti+5 mass % BeO-based mixed powder sintered compact.

When the structure micrograph of FIG. 27 is seen, it can be confirmed that the Ti—Be-based compound is dispersed in the matrix of titanium.

(9) Ti+5 Mass % $CoO_2$

Figure 12:
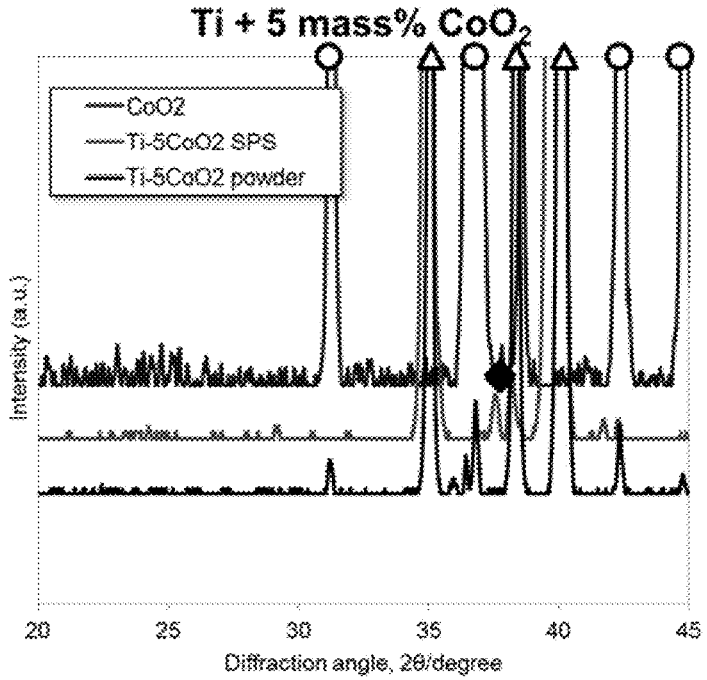
FIG. 12 is a view showing an X-ray diffraction result of Ti+5 mass % $CoO_2$-based mixed powder and sintered compacts.

Reference is made to the mixed powder of Ti+5 mass % $CoO_2$ shown in FIG. 12. In the $CoO_2$ particles (the line located at the uppermost position), the peak "○" of $CoO_2$ appears, for example, at the diffraction angle near 31 degrees. In the mixed powder (the line located at the lowermost position) also, the peak of $CoO_2$ appears at the diffraction angle near 31 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $CoO_2$ at the diffraction angle near 31 degrees has disappeared. This means that $CoO_2$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and cobalt atoms dissociated by decomposition of the cobalt oxide are dissolved as a solute of solid solution in the crystal lattice of the hexagonal close-packed structure of titanium.

When further attention is paid to the sintered compact, it is found out that a peak of a compound of titanium and cobalt (Ti—Co-based compound) newly appears at the diffraction angle near 37 degrees. This means that the cobalt atoms dissociated by decomposition of the cobalt oxide have reacted with titanium to form the Ti—Co-based compound to be dispersed in the matrix of titanium.

Figure 28:
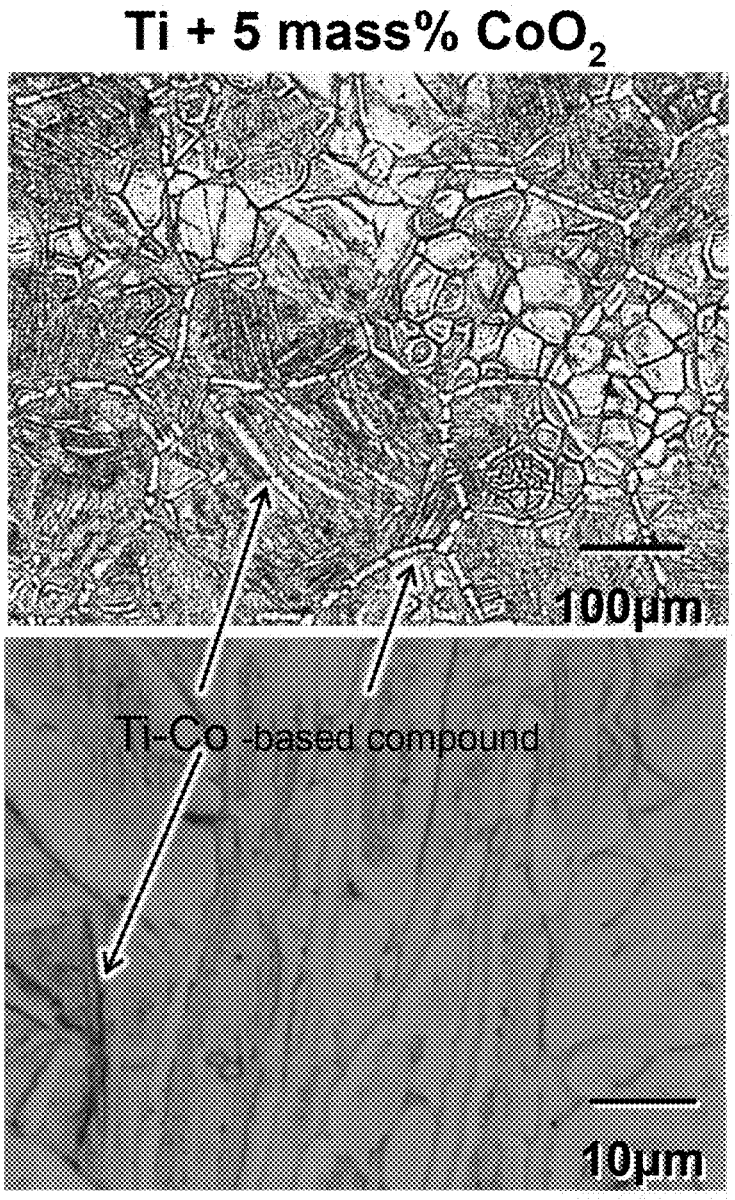
FIG. 28 is a structure micrograph of Ti+5 mass % $CoO_2$-based mixed powder sintered compact.

When the structure micrograph of FIG. 28 is seen, it can be confirmed that the Ti—Co-based compound is dispersed in the matrix of titanium.

(10) Ti+5 Mass % FeO

Figure 13:
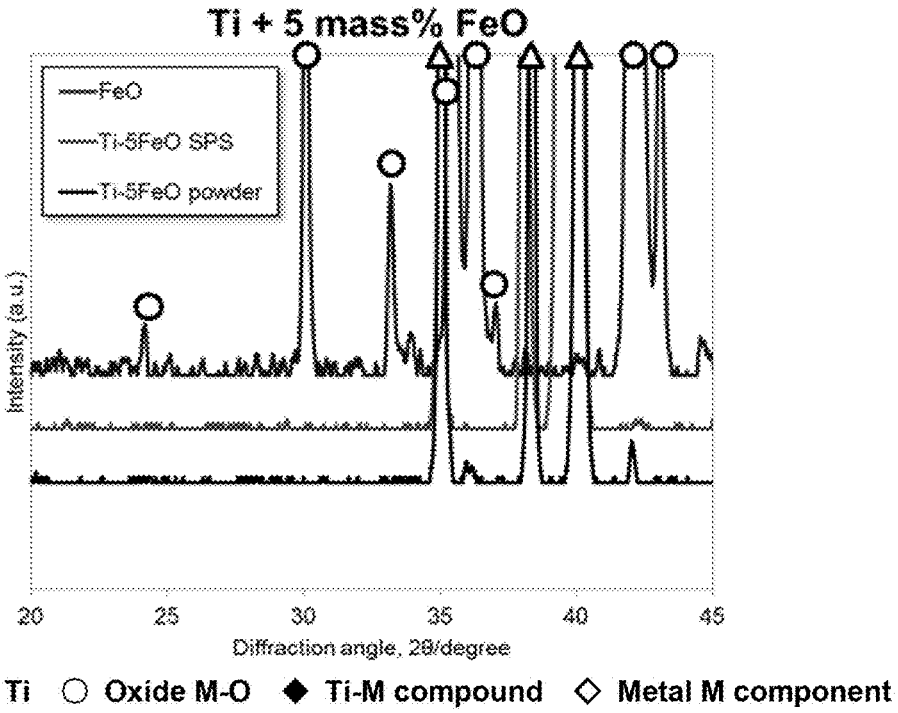
FIG. 13 is a view showing an X-ray diffraction result of Ti+5 mass % FeO-based mixed powder and sintered compacts.

Reference is made to the mixed powder of Ti+5 mass % FeO shown in FIG. 13. In the FeO particles (the line located at the uppermost position), the peak "○" of FeO appears, for example, at the diffraction angle near 42 degrees. In the mixed powder (the line located at the lowermost position) also, the peak of FeO appears at the diffraction angle near 42 degrees, and also the peak "Δ" of pure titanium appears at the diffraction angles near 35 degrees, near 38 degrees, and near 40 degrees.

When attention is paid to the sintered compact (the line located at the middle position), it is found out that the peak of FeO at the diffraction angle near 42 degrees has disappeared. This means that FeO has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and iron atoms dissociated by decomposition of the iron oxide are dissolved as a solute of solid solution in the crystal lattice of the hexagonal close-packed structure of titanium.

When further attention is paid to the sintered compact, it is found out that neither a peak of a compound of titanium and iron (Ti—Fe-based compound) nor a peak of iron appears. This means that all of the iron atoms dissociated by decomposition of iron oxide are dissolved as a solute of solid solution in the crystal lattice of the hexagonal close-packed structure of titanium.

Figure 29:
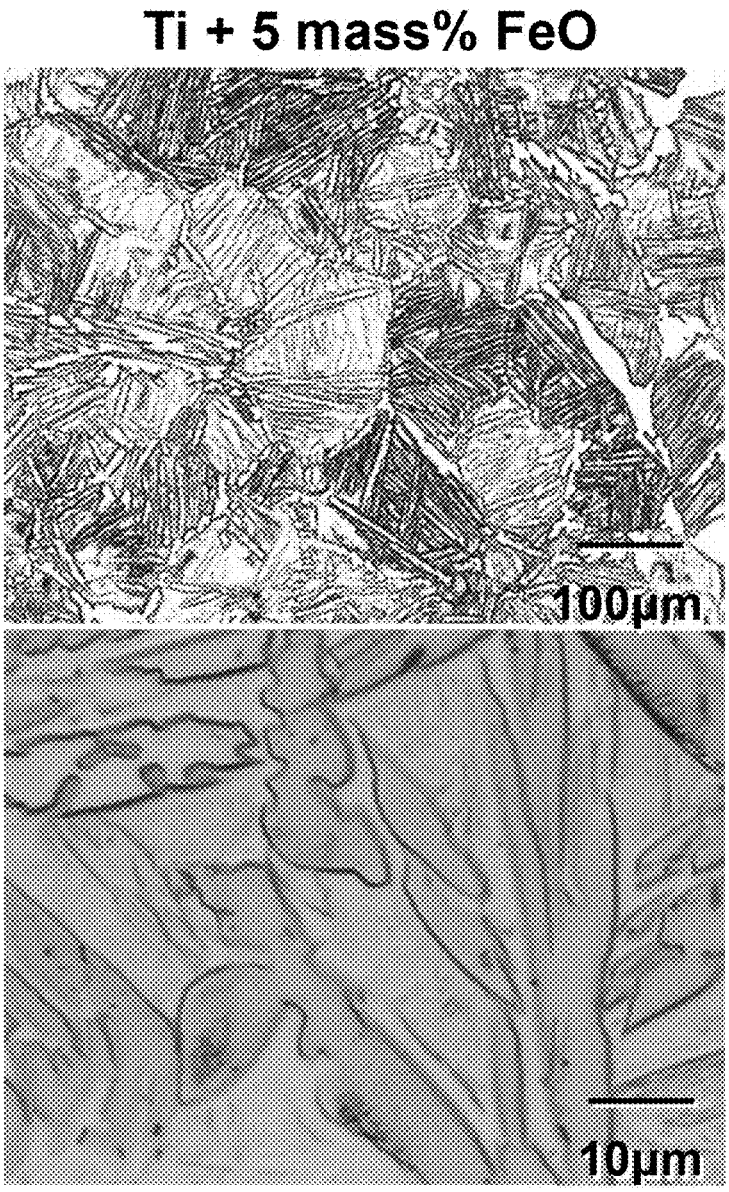
FIG. 29 is a structure micrograph of Ti+5 mass % FeO-based mixed powder sintered compact.

When the structure micrograph of FIG. 29 is seen, it can be confirmed that neither the Ti—Fe-based compound nor the Fe component appears in the matrix of titanium.

(11) Ti+5 Mass % MnO

Figure 14:
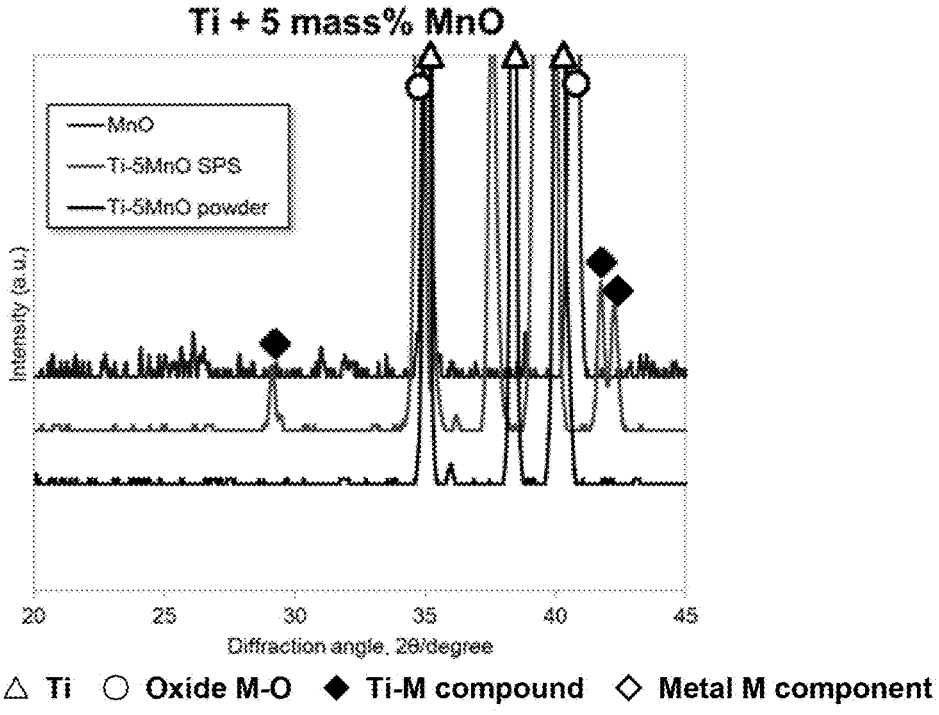
FIG. 14 is a view showing an X-ray diffraction result of Ti+5 mass % MnO-based mixed powder and sintered compacts.

Reference is made to the mixed powder of Ti+5 mass % MnO shown in FIG. 14. In the MnO particles (the line located at the uppermost position), the peak "○" of MnO appears, for example, at the diffraction angles near 31 degrees and near 41 degrees.

When attention is paid to the sintered compact (the line located at the middle position), it is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and manganese atoms dissociated by decomposition of the manganese oxide are dissolved as a solute of solid solution in the crystal lattice of the hexagonal close-packed structure of titanium.

When further attention is paid to the sintered compact, it is found out that a peak of a compound of titanium and manganese (Ti—Mn-based compound) newly appears at the diffraction angle near 29 degrees. This means that the manganese atoms dissociated by decomposition of the manganese oxide have reacted with titanium to form the Ti—Mn-based compound to be dispersed in the matrix of titanium.

Figure 30:
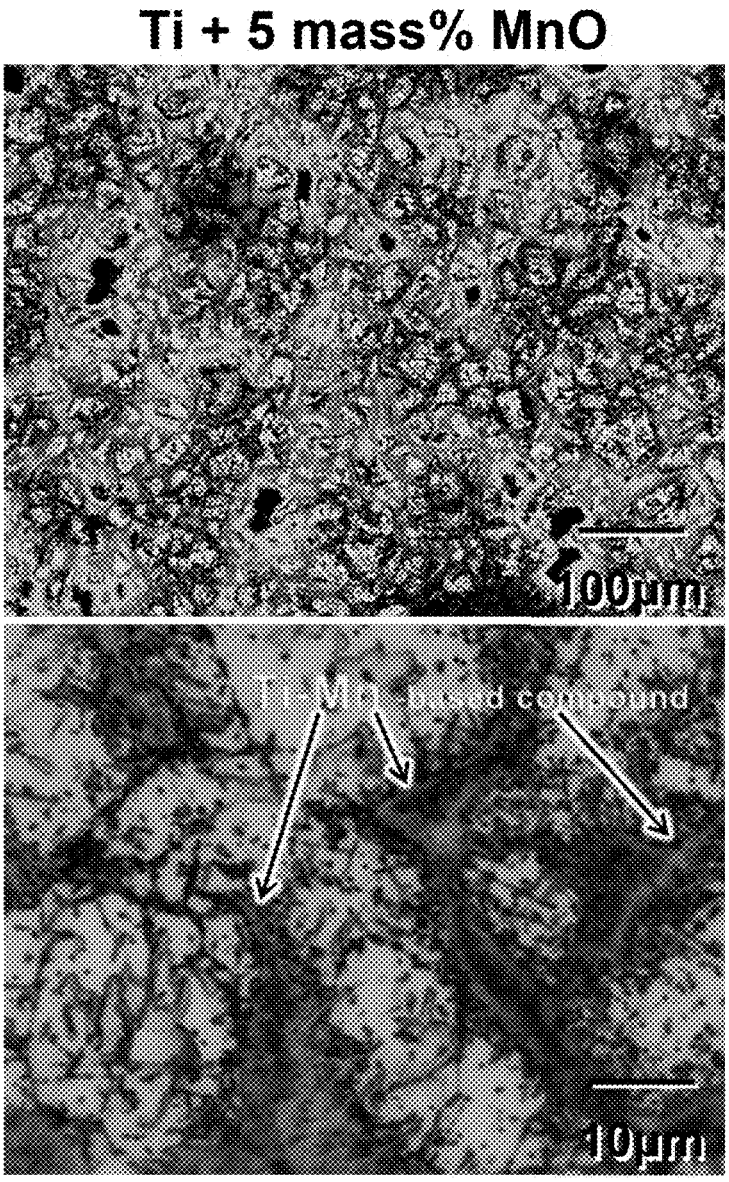
FIG. 30 is a structure micrograph of Ti+5 mass % MnO-based mixed powder sintered compact.

When the structure micrograph of FIG. 30 is seen, it can be confirmed that the Ti—Mn-based compound is dispersed in the matrix of titanium.

(12) Ti+5 Mass % $V_2O_3$

Figure 15:
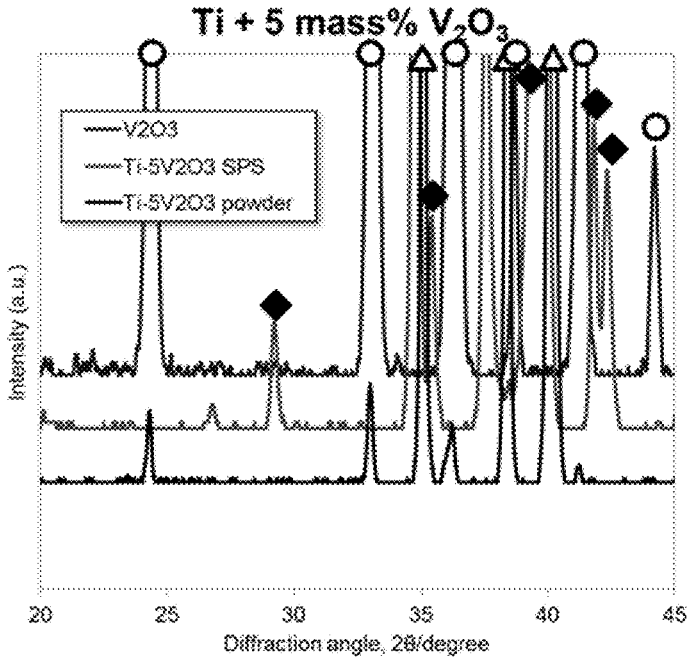
FIG. 15 is a view showing an X-ray diffraction result of Ti+5 mass % $V_2O_3$-based mixed powder and sintered compacts.

Reference is made to the mixed powder of Ti+5 mass % $V_2O_3$ shown in FIG. 15. In the $V_2O_3$ particles (the line located at the uppermost position), the peak "○" of $V_2O_3$ appears, for example, at the diffraction angle near 24 degrees. In the mixed powder (the line located at the lowermost position) also, the peak of $V_2O_3$ appears at the diffraction angle near 24 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $V_2O_3$ at the diffraction angle near 24 degrees has disappeared. This means that $V_2O_3$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and vanadium atoms dissociated by decomposition of the vanadium oxide are dissolved as a solute of solid solution in the crystal lattice of the hexagonal close-packed structure of titanium.

When further attention is paid to the sintered compact, it is found out that a peak of a compound of titanium and vanadium (Ti—V-based compound) newly appears at the diffraction angle near 29 degrees. This means that the vanadium atoms dissociated by decomposition of the vanadium oxide have reacted with titanium to form the Ti—V-based compound to be dispersed in the matrix of titanium.

Figure 31:
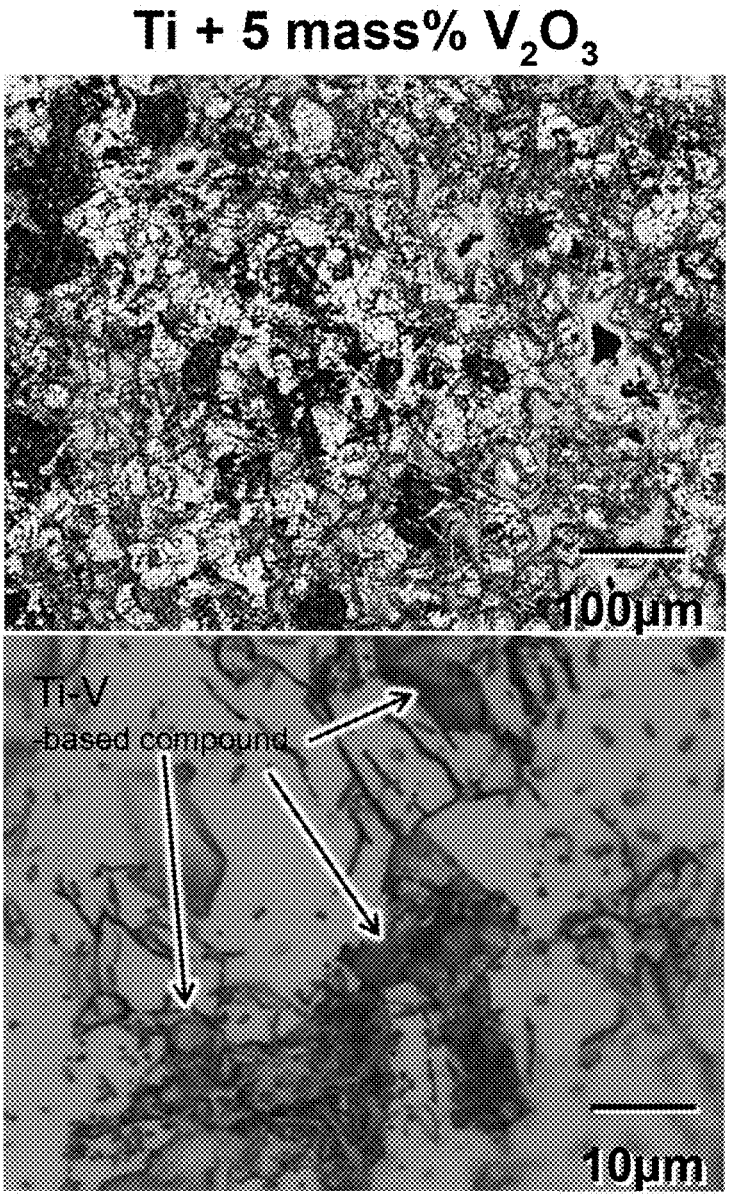
FIG. 31 is a structure micrograph of Ti+5 mass % $V_2O_3$-based mixed powder sintered compact.

When reference is made to FIG. 31, it can be confirmed that the Ti—V-based compound is dispersed in the matrix of titanium.

(13) Ti+5 Mass % $ZrO_2$

Figure 16:
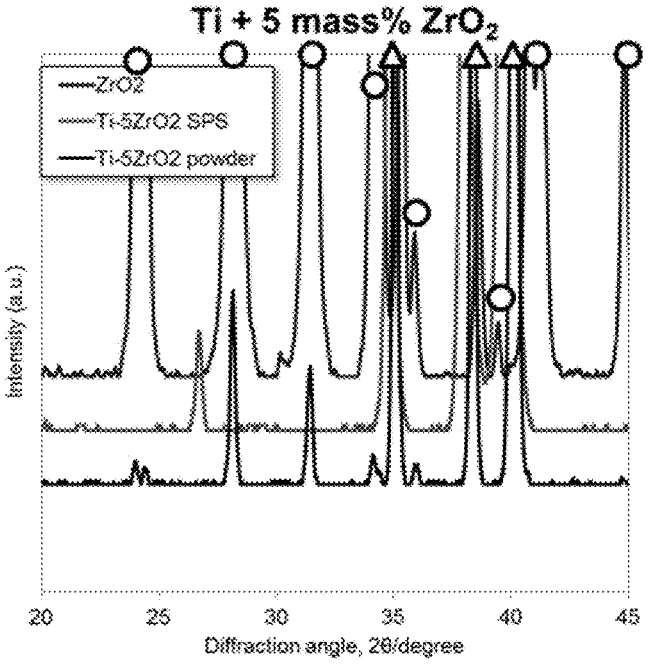
FIG. 16 is a view showing an X-ray diffraction result of Ti+5 mass % $ZrO_2$-based mixed powder and sintered compacts.

Reference is made to the mixed powder of Ti+5 mass % $ZrO_2$ shown in FIG. 16. In the $ZrO_2$ particles (the line located at the uppermost position), the peak "○" of $ZrO_2$ appears, for example, at the diffraction angle near 25 degrees. In the mixed powder (the line located at the lowermost position) also, the peak of $ZrO_2$ appears at the diffraction angle near 25 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $ZrO_2$ at the diffraction angle near 25 degrees has disappeared. This means that $ZrO_2$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and zirconium atoms dissociated by decomposition of the zirconium oxide are dissolved as a solute of solid solution in the crystal lattice of the hexagonal close-packed structure of titanium.

When further attention is paid to the sintered compact, it is found out that neither a peak of a compound of titanium and zirconium (Ti—Zr-based compound) nor a peak of zirconium appears. This means that all of the zirconium atoms dissociated by decomposition of zirconium oxide are dissolved as a solute of solid solution in the crystal lattice of the hexagonal close-packed structure of titanium.

Figure 32:
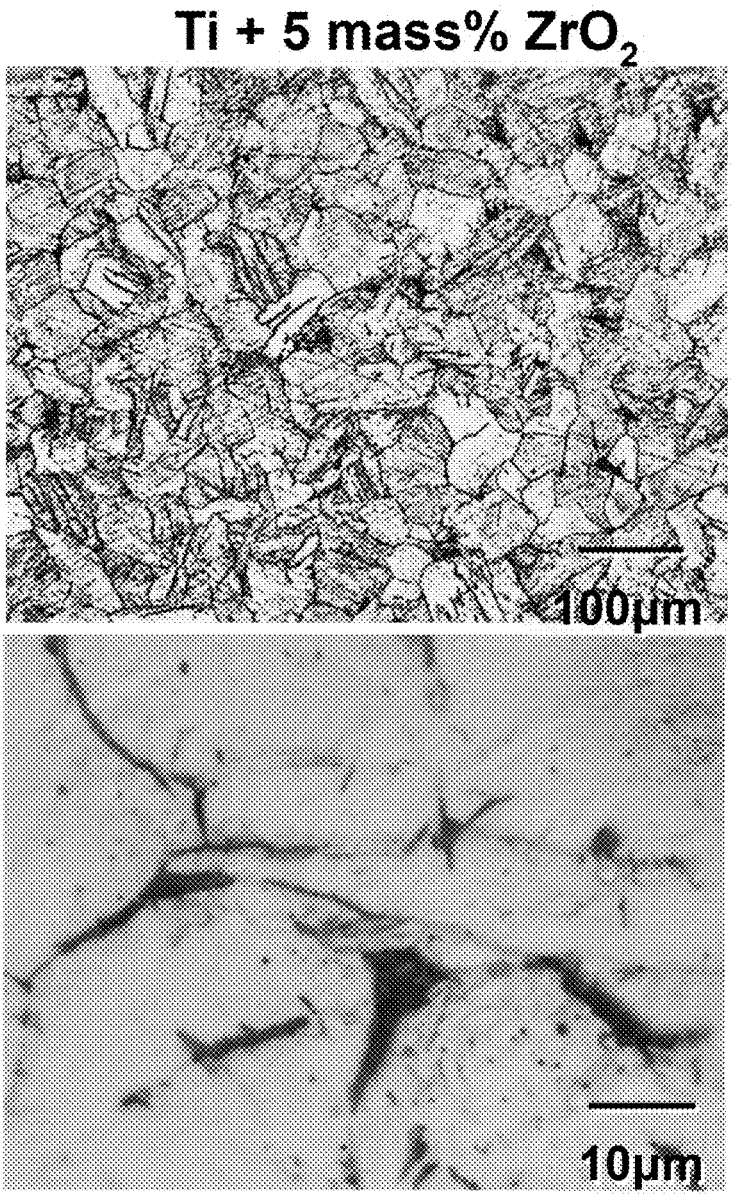
FIG. 32 is a structure micrograph of Ti+5 mass % $ZrO_2$-based mixed powder sintered compact.

When the structure micrograph of FIG. 32 is seen, it can be confirmed that neither the Ti—Zr-based compound nor the Zr component appears in the matrix of titanium.

(14) Ti+5 Mass % SnO

Figure 17:
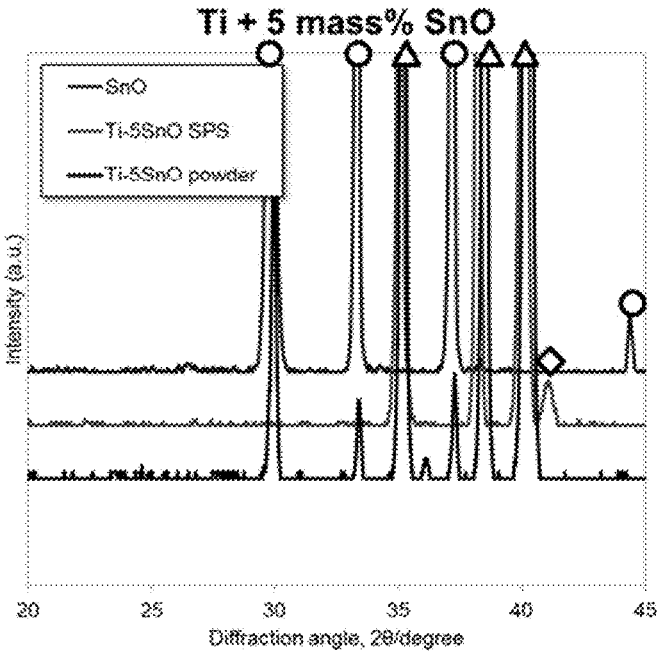
FIG. 17 is a view showing an X-ray diffraction result of Ti+5 mass % SnO-based mixed powder and sintered compacts.

Reference is made to the mixed powder of Ti+5 mass % SnO shown in FIG. 17. In the SnO particles (the line located at the uppermost position), the peak "○" of SnO appears, for example, at the diffraction angle near 30 degrees. In the mixed powder (the line located at the lowermost position) also, the peak of SnO appears, and also the peak "Δ" of pure titanium appears at the diffraction angles near 35 degrees, near 38 degrees, and near 40 degrees.

When attention is paid to the sintered compact (the line located at the middle position), it is found out that the peak of SnO at the diffraction angle near 30 degrees has disappeared. This means that SnO has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted a little toward one angle side as compared with that before the sintering. This is because the oxygen atoms dissociated by decomposition of the tin oxide are dissolved as a solute of solid solution in the crystal lattice of the hexagonal close-packed structure of titanium.

When further attention is paid to the sintered compact, it is found out that a peak of tin appears at the diffraction angle near 41 degrees. This means that the tin atoms dissociated by decomposition of the tin oxide are deposited in the matrix of titanium.

Figure 33:
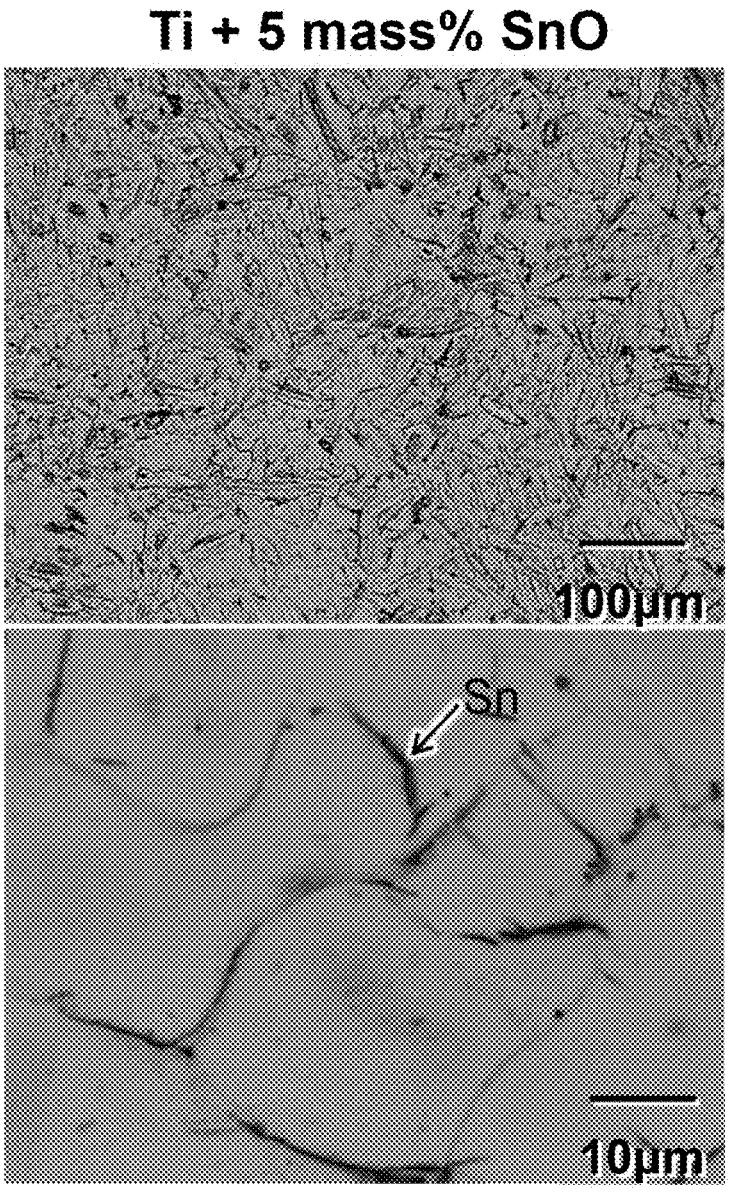
FIG. 33 is a structure micrograph of Ti+5 mass % SnO-based mixed powder sintered compact.

When the structure micrograph of FIG. 33 is seen, it can be confirmed that the Sn component is deposited in the matrix of titanium.

(15) Ti+5 Mass % $Cr_2O_3$

Figure 18:
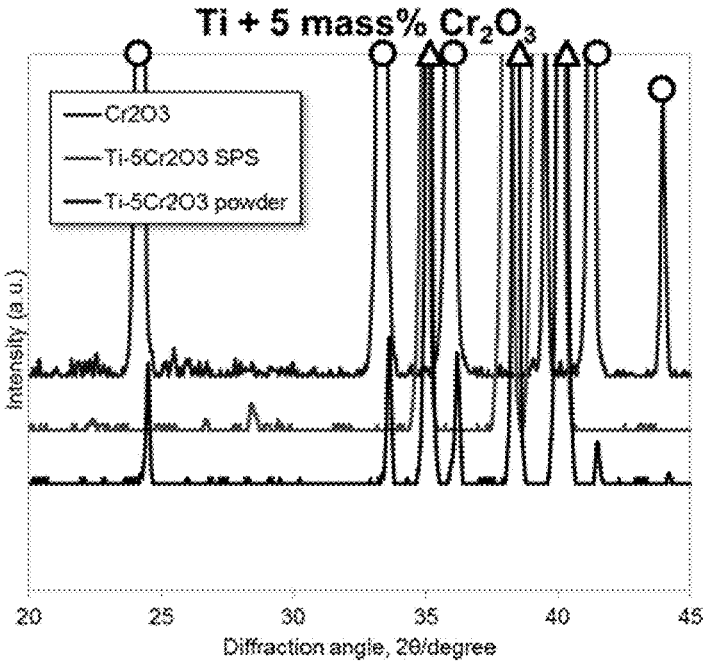
FIG. 18 is a view showing an X-ray diffraction result of Ti+5 mass % $Cr_2O_3$-based mixed powder and sintered compacts.

Reference is made to the mixed powder of Ti+5 mass % $Cr_2O_3$ shown in FIG. 18. In the $Cr_2O_3$ particles (the line located at the uppermost position), the peak "○" of $Cr_2O_3$ appears, for example, at the diffraction angle near 25 degrees. In the mixed powder (the line located at the lowermost position) also, the peak of $Cr_2O_3$ appears at the diffraction angle near 25 degrees, and also the peak "Δ" of pure titanium appears at the diffraction angles near 35 degrees, near 38 degrees, and near 40 degrees.

When attention is paid to the sintered compact (the line located at the middle position), it is found out that the peak of $Cr_2O_3$ at the diffraction angle near 25 degrees has disappeared. This means that $Cr_2O_3$ has been decomposed by the sintering treatment. It is recognized that, though the peak of pure titanium appears at the diffraction angles near 35 degrees, near 38 degrees, and near 40 degrees, the position of the peak of pure titanium after the sintering treatment is shifted toward one angle side as compared with that before the sintering. This is because the oxygen atoms and chromium atoms dissociated by decomposition of the chromium oxide are dissolved as a solute of solid solution in the crystal lattice of the hexagonal close-packed structure of titanium.

When further attention is paid to the sintered compact, it is found out that neither a peak of a compound of titanium and chromium (Ti—Cr-based compound) nor a peak of chromium appears. This means that all of the chromium atoms dissociated by decomposition of chromium oxide are dissolved as a solute of solid solution in the crystal lattice of the hexagonal close-packed structure of titanium.

(16) Ti+10 Mass % MgO

Figure 19:
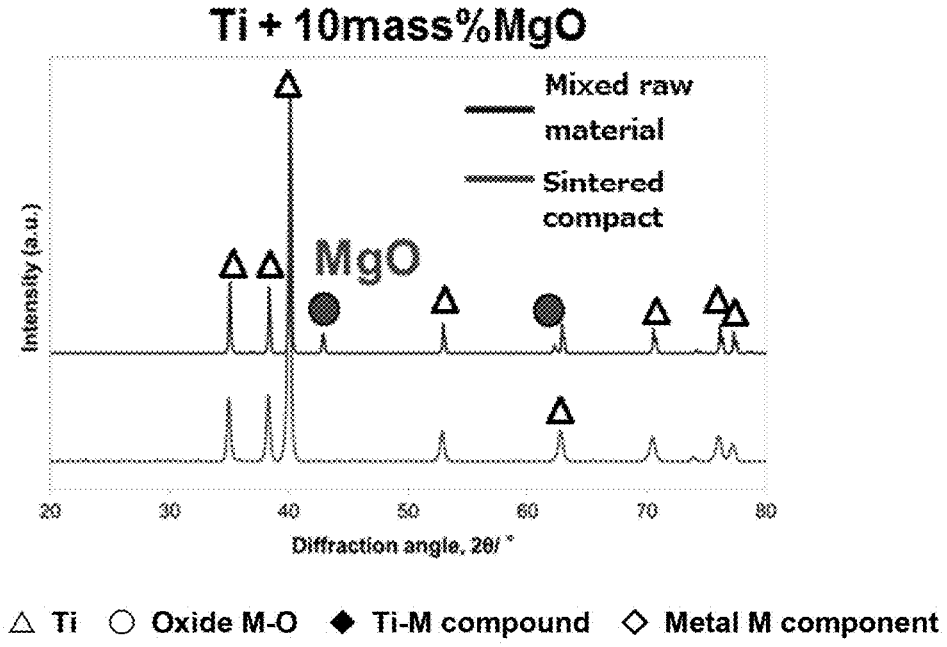
FIG. 19 is a view showing an X-ray diffraction result of Ti+10 mass % MgO-based mixed powder and sintered compacts.

Reference is made to the mixed powder of Ti+10 mass % MgO shown in FIG. 19. In the mixed powder (the line located above), a peak of MgO appears at the diffraction angle near 42 degrees; however, this peak of MgO has disappeared in the sintered compact. This means that MgO has been decomposed by the sintering treatment.

[Result of Micro Vickers (Hv) Hardness Measurement of Sintered Compact]

The sintered compacts of various types described above (those obtained by performing spark plasma sintering on a shaped compact of a mixed powder of pure titanium powder and metal oxide particles) were subjected to extrusion forming under the following conditions, so as to prepare samples for hardness measurement and tensile strength measurement.

The micro Vickers hardness (Hv) was measured under the following conditions to give the following results. Here, for each sample, hardness was measured at 20 sites, and an average hardness thereof was calculated.

Hardness measurement conditions: load weight of 100 g/time for 15 seconds

Pure Ti: 208
Ti+5% $SiO_2$: 779
Ti+5% $Ta_2O_5$: 434
Ti+5% $\alpha Al_2O_3$: 861
Ti+5% $\gamma Al_2O_3$: 626
Ti+5% CuO: 471
Ti+5% $Cu_2O$: 466
Ti+5% $Nb_2O_5$: 459
Ti+5% BeO: 661
Ti+5% $CoO_2$: 656
Ti+5% FeO: 519
Ti+5% MnO: 809
Ti+5% $V_2O_3$: 847
Ti+5% $ZrO_2$: 567
Ti+5% SnO: 387
Ti+5% $Cr_2O_3$: 544

As will be clear from the above measurement results, a compact obtained by sintering a mixed powder of pure titanium powder and metal oxide particles shows a considerable rise in the micro Vickers hardness as compared with pure titanium. In particular, rise in the hardness is considerable in the sintered compact of Ti+5% $SiO_2$, sintered compact of Ti+5% $\alpha Al_2O_3$, sintered compact of Ti+5% MnO, and sintered compact of Ti+5% $V_2O_3$. The reason why the hardness of the sintered compact rises in this manner is that, at the time of sintering treatment, the metal oxide is decomposed, and the dissociated oxygen atoms are dissolved as a solute of solid solution in the crystal lattice of titanium, and further the dissociated metal atoms are dissolved as a solute of solid solution in the crystal lattice of titanium, or are deposited in the matrix of titanium, or form a compound with titanium to be dispersed in the matrix of titanium, thereby increasing the strength.

[Results of Tensile Test of Extruded Material of Ti64+$ZrO_2$-Based Sintered Compact]

A tensile test was carried out at an ordinary temperature on a sample of an extruded material of Ti64+$ZrO_2$-based sintered compact, so as to measure the tensile strength (MPa) and the elongation (%). The results are shown in the following Table 1 and in the stress-elongation diagram of FIG. 34. Here, the chemical composition of the Ti64 alloy is Ti-6Al-4V.

TABLE 1

| Sintered extruded material | Yield strength (YS) MPa | Tensile strength (UTS) MPa | Elongation % | Micro Vickers hardness Hv0.05 |
|---|---|---|---|---|
| Ti64 | 941 | 1050 | 16.5 | 325 |
| Ti64 + 0.1 mass % $ZrO_2$ | 960 | 1083 | 17.4 | 322 |
| Ti64 + 0.3 mass % $ZrO_2$ | 1128 | 1284 | 15.2 | 380 |
| Ti64 + 0.5 mass % $ZrO_2$ | 1172 | 1308 | 23.3 | 387 |
| Ti64 + 0.7 mass % $ZrO_2$ | 1214 | 1332 | 18.1 | 406 |
| Ti64 + 0.9 mass % $ZrO_2$ | 1163 | 1241 | 8.7 | 451 |

Figure 34:
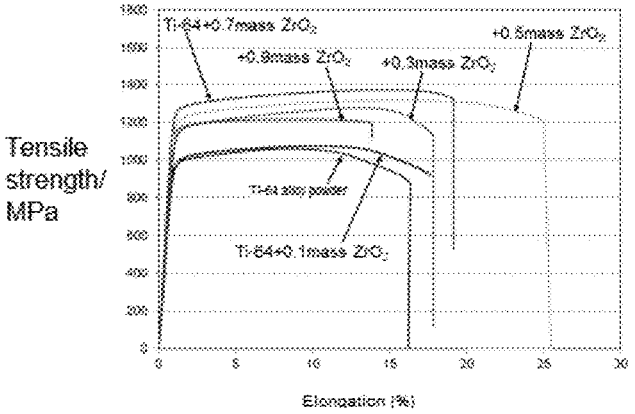
FIG. 34 is a stress-elongation diagram of Ti64+$ZrO_2$-based mixed powder sintered extruded material.

What will be understood from Table 1 and FIG. 34 is that a sintered extruded material of a mixed powder of Ti64 alloy powder and $ZrO_2$ particles has a higher hardness and a higher tensile strength than a sintered extruded material of Ti64 alloy powder. This effect starts to be exhibited when the amount of addition of $ZrO_2$ is 0.1 mass %.

When attention is paid to the elongation (%), the samples in which the amount of addition of $ZrO_2$ is 0.1 mass % to 0.7 mass % exhibit a higher elongation property than the sintered extruded material of Ti64; however, the sample in which the amount of addition of $ZrO_2$ is 0.9 mass % is inferior in the elongation property as compared with the Ti64 sintered extruded material.

As is determined from the above results, in the case of a sintered extruded material of Ti64-$ZrO_2$, it is preferable to set the amount of addition of $ZrO_2$ to be within a range of 0.1 mass % to 0.8 mass % in order to improve the properties of hardness, tensile strength, and elongation.

[Method of Production and Result of Tensile Test of Ti+$Al_2O_3$(α)-Based Mixed Powder Sintered Extruded Material]

(1) Powder Mixing Step

A pure Ti powder fabricated by the hydrogenation-dehydrogenation method and having an average particle size of 20 μm and α alumina particles ($\alpha Al_2O_3$) having an average particle size of 1.8 μm were prepared. To the pure Ti powder, 0.02 mass % of oil was added, and the oil was applied onto a Ti powder surface by mixing with a table ball mill for one hour. To the pure Ti powder having the oil applied thereon, $Al_2O_3$ particles were added within a range of 0.0 to 1.5 mass % (relative to the total mixed powder), followed by mixing with use of a rocking mill mixing apparatus under the conditions with a frequency of 60 Hz and a mixing time of one hour, thereby to fabricate a mixed powder.

(2) Vacuum Pressing Sintering Step and Homogenizing Heat Treatment Step

Pressurized vacuum sintering was carried out on the above mixed powder with use of a spark plasma sintering machine (SPS) under the conditions with a sintering temperature of 1273 K, holding time of 3.6 ks, an applied pressure of 30 MPa, and a vacuum degree of 6 Pa or less. On the sintered compact thus fabricated, a heat treatment was carried out in a vacuum electric furnace at 1273 K and 10.8 ks for the homogenizing treatment.

(3) Hot Extrusion Step

The temperature of the sintered compact subjected to the above heat treatment was raised with use of an infrared rapid heating furnace in an Ar gas atmosphere up to 1273 K at a heating rate of 2 K/s and, after the sintered compact was held at the temperature of 1273 K for 180 seconds, hot extrusion forming was immediately carried out with use of a hydraulically driven pressing machine, so as to fabricate an extruded rod material having a diameter ϕ of 15 mm. At that time, the extrusion ratio was set to be 6, and the extrusion speed was set to be 3 mm/s in terms of ram speed.

(4) Tensile Test

A tensile test was carried out on the above sintered extruded rod material in an ordinary-temperature ambient air atmosphere, so as to measure the tensile strength (MPa) and the elongation (%). The rate of strain was set to be $5\times 10^{-4}$ $s^{-1}$. The results are shown in Table 2.

TABLE 2

| Sintered extruded material | Yield strength (YS) MPa | Tensile strength (UTS) MPa | Elongation % |
|---|---|---|---|
| Pure Ti | 438 | 579 | 26.5 |
| Ti + 0.5mass % $Al_2O_3$ | 678 | 841 | 26.2 |
| Ti + 1.0mass % $Al_2O_3$ | 782 | 935 | 15.5 |
| Ti + 1.5mass % $Al_2O_3$ | 915 | 1029 | 1.6 |

As will be clear from the result of Table 2, the Ti+$\alpha Al_2O_3$-based sintered extruded material shows a considerable rise in the yield strength (YS) and the tensile strength (UTS) as compared with pure Ti. On the other hand, when the amount of addition of $\alpha Al_2O_3$ increases, the elongation decreases. Specifically, when the amount of $\alpha Al_2O_3$ is 1.5 mass %, the elongation considerably decreases.

When the sintered extruded material is used as a structural material, it is not regarded as a problem if the elongation value is 5% or more. It is believed that the elongation value of 10% or more is more preferable. From such a viewpoint, the Ti+1.0 mass % $\alpha Al_2O_3$-based sintered extruded material can be satisfactorily used as a structural material because of having an elongation value of 15.5%.

From the results of Table 2, it seems that the amount of addition of $\alpha Al_2O_3$ (relative to the total mixed powder) is preferably set to be about 0.1 mass % to 1.3 mass %.

[Method of Production and Result of Tensile Test of Ti+$V_2O_5$-Based Mixed Powder Sintered Extruded Material]

(1) Powder Mixing Step

A pure Ti powder fabricated by the hydrogenation-dehydrogenation method and having an average particle size of 20 μm and vanadium oxide particles ($V_2O_5$) having an average particle size of 2.2 μm were prepared. To the pure Ti powder, 0.02 mass % of oil was added, and the oil was applied onto a Ti powder surface by mixing with a table ball mill for one hour. To the pure Ti powder having the oil applied thereon, $V_2O_5$ particles were added within a range of 0.0 to 1.5 mass % (relative to the total mixed powder), followed by mixing with use of a rocking mill mixing apparatus under the conditions with a frequency of 60 Hz and a mixing time of one hour, thereby to fabricate a mixed powder.

(2) Vacuum Pressing Sintering Step and Homogenizing Heat Treatment Step

Pressurized vacuum sintering was carried out on the above mixed powder with use of a spark plasma sintering machine (SPS) under the conditions with a sintering temperature of 1273 K, holding time of 3.6 ks, an applied pressure of 30 MPa, and a vacuum degree of 6 Pa or less. On the sintered compact thus fabricated, a heat treatment was carried out in a vacuum electric furnace at 1273 K and 10.8 ks for the homogenizing treatment.

(3) Hot Extrusion Step

The temperature of the sintered compact subjected to the above heat treatment was raised with use of an infrared rapid heating furnace in an Ar gas atmosphere up to 1273 K at a heating rate of 2 K/s and, after the sintered compact was held at the temperature of 1273 K for 180 seconds, hot extrusion forming was immediately carried out with use of a hydraulically driven pressing machine, so as to fabricate an extruded rod material having a diameter ϕ of 15 mm. At that time, the extrusion ratio was set to be 6, and the extrusion speed was set to be 3 mm/s in terms of ram speed.

(4) Tensile Test

A tensile test was carried out on the above sintered extruded rod material in an ordinary-temperature ambient air atmosphere, so as to measure the tensile strength (MPa) and the elongation (%). The rate of strain was set to be $5\times10^{-4}$ $s^{-1}$. The results are shown in Table 3.

TABLE 3

| Sintered extruded material | Yield strength (YS) MPa | Tensile strength (UTS) MPa | Elongation % |
|---|---|---|---|
| Pure Ti | 438 | 579 | 26.5 |
| Ti + 0.5mass % $V_2O_5$ | 635 | 777 | 28.9 |
| Ti + 1.0mass % $V_2O_5$ | 779 | 932 | 24.1 |
| Ti + 1.5mass % $V_2O_5$ | 954 | 1029 | 2.7 |

As will be clear from the result of Table 3, the Ti+$V_2O_5$-based sintered extruded material shows a considerable rise in the yield strength (YS) and the tensile strength (UTS) as compared with pure Ti. On the other hand, when the amount of addition of $V_2O_5$ increases, the elongation decreases. Specifically, when the amount of $V_2O_5$ is 1.5 mass %, the elongation considerably decreases.

When the sintered extruded material is used as a structural material, it is not regarded as a problem if the elongation value is 5% or more. It is believed that the elongation value of 10% or more is more preferable. From such a viewpoint, the Ti+1.0 mass % $V_2O_5$-based sintered extruded material can be satisfactorily used as a structural material because of having an elongation value of 24.1%.

From the results of Table 3, it seems that the amount of addition of $V_2O_5$ (relative to the total mixed powder) is preferably set to be about 0.1 mass % to 1.3 mass %.

[Strengthening Mechanism of Metal Atoms (Metal Component) Dissociated by Decomposition of Metal Oxide Particles]

When a titanium component powder made of a titanium component having an α phase and metal oxide particles are mixed and sintered, the metal oxide is decomposed, and the dissociated oxygen atoms are dissolved as a solute of solid solution in the crystal lattice of titanium, and further the dissociated metal atoms are dissolved as a solute of solid solution in the crystal lattice of titanium, or are deposited in the matrix of titanium, or form a compound with titanium to be dispersed in the matrix of titanium. The strengthening mechanism of the metal atoms or the metal component may differ depending on the type of the metal constituting the metal oxide. The following Table 4 is an organized summary of the strengthening mechanism of the metal atoms or the metal component.

TABLE 4

| | M atom solid solution strengthening | Ti—M - based compound dispersion strengthening | M component deposition strengthening | Impartation of function to Ti by metal M |
|---|---|---|---|---|
| Ti + 5% $SiO_2$ | ○ | ○ | | Improvement in hardness, abrasion resistance, and heat resistance |
| Ti + 5% $Ta_2O_5$ | ○ | | | Improvement in ductility, bioaffinity |
| Ti + 5% α $Al_2O_3$ | ○ | ○ | | Improvement in hardness, abrasion resistance, and heat resistance |
| Ti + 5% γ $Al_2O_3$ | ○ | ○ | | Improvement in hardness, abrasion resistance, and heat resistance |
| Ti + 5% CuO | ○ | ○ | | Improvement in heat resistance |
| Ti + 5% $Cu_2O$ | ○ | ○ | | Improvement in heat resistance |
| Ti + 5% $Nb_2O_5$ | ○ | ○ | | Improvement in oxidation resistance |
| Ti + 5% BeO | ○ | ○ | | Improvement in hardness, abrasion resistance, and heat resistance |
| Ti + 5% $CoO_2$ | ○ | ○ | | Improvement in hardness, abrasion resistance, and heat resistance |
| Ti + 5% FeO | ○ | | | Improvement in heat resistance |
| Ti + 5% MnO | ○ | ○ | | Improvement in hardness, abrasion resistance, and heat resistance |

TABLE 4-continued

| | M atom solid solution strengthening | Ti—M - based compound dispersion strengthening | M component deposition strengthening | Impartation of function to Ti by metal M |
|---|---|---|---|---|
| Ti + 5% $V_2O_3$ | ○ | ○ | | Improvement in hardness, abrasion resistance, and heat resistance, bioaffinity |
| Ti + 5% $ZrO_2$ | ○ | | | Improvement in heat resistance, bioaffinity |
| Ti + 5% SnO | | | ○ | Improvement in ductility |
| Ti + 5% $Cr_2O_3$ | ○ | | | Improvement in hardness and heat resistance |

In Table 4, in the case of the Ti+5% $SiO_2$ sintered compact extruded material, the silicon atoms are dissolved as a solute of solid solution into the crystal lattice of Ti, and part of the silicon atoms react with Ti to form a Ti—Si-based compound to be dispersed in the matrix of Ti. The strengthening mechanism to titanium is solid solution strengthening of the oxygen atoms, solid solution strengthening of the silicon atoms, and dispersion strengthening of the Ti—Si-based compound. This strengthening mechanism improves the hardness, abrasion resistance, and heat resistance of the titanium component material.

In the case of the Ti+5% $Ta_2O_5$ sintered compact extruded material, the tantalum atoms are dissolved as a solute of solid solution into the crystal lattice of titanium. The strengthening mechanism to titanium is solid solution strengthening of the oxygen atoms and solid solution strengthening of the tantalum atoms, and this strengthening mechanism improves the ductility of the titanium component material and imparts a bioaffinity.

In the case of the Ti+5% SnO sintered compact extruded material, the tin atoms are deposited in the matrix of Ti. The strengthening mechanism to titanium is solid solution strengthening of the oxygen atoms and deposition strengthening of the tin atoms, and this strengthening mechanism improves the ductility of the titanium component material.

[Method of Production and Result of Tensile Test of Ti+$ZrO_2$-Based Mixed Powder Sintered Extruded Material as Well as Preferable Amount of Addition of $ZrO_2$]

(1) Powder Mixing Step

A pure Ti powder fabricated by the hydrogenation-dehydrogenation method and having an average particle size of 20 μm and zirconium oxide particles ($ZrO_2$) having an average particle size of 2.0 μm were prepared. To the pure Ti powder, 0.02 mass % of oil was added, and the oil was applied onto a Ti powder surface by mixing with a table ball mill for one hour. To the pure Ti powder having the oil applied thereon, $ZrO_2$ particles were added within a range of 0.0 to 4.0 mass % (relative to the total mixed powder), followed by mixing with use of a rocking mill mixing apparatus under the conditions with a frequency of 60 Hz and a mixing time of one hour, thereby to fabricate a mixed powder.

(2) Vacuum Pressing Sintering Step and Homogenizing Heat Treatment Step

Pressurized vacuum sintering was carried out on the above mixed powder with use of a spark plasma sintering machine (SPS) under the conditions with a sintering temperature of 1173 K, holding time of 10.8 ks, an applied pressure of 30 MPa, and a vacuum degree of 6 Pa or less. On the sintered compact thus fabricated, a heat treatment was carried out in a vacuum electric furnace at 1773 K and 10.8 ks for the homogenizing treatment.

(3) Hot Extrusion Step

The temperature of the sintered compact subjected to the above heat treatment was raised with use of an infrared rapid heating furnace in an Ar gas atmosphere up to 1273 K at a heating rate of 2 K/s and, after the sintered compact was held at the temperature of 1273 K for 300 seconds, hot extrusion forming was immediately carried out with use of a hydraulically driven pressing machine, so as to fabricate an extruded rod material having a diameter ϕ of 10 mm. At that time, the extrusion ratio was set to be 18.5, and the extrusion speed was set to be 3 mm/s in terms of ram speed.

(4) Tensile Test

A tensile test was carried out on the above sintered extruded rod material in an ordinary-temperature ambient air atmosphere, so as to measure the tensile strength (MPa) and the elongation (%). The rate of strain was set to be $5\times10^{-4}$ $s^{-1}$. Also, the hardness measurement conditions were set to be load weight of 50 g for the time of 15 seconds and, for each sample, the micro Vickers hardness (Hv) was measured at 20 sites, and an average hardness thereof was calculated.

Figure 35:
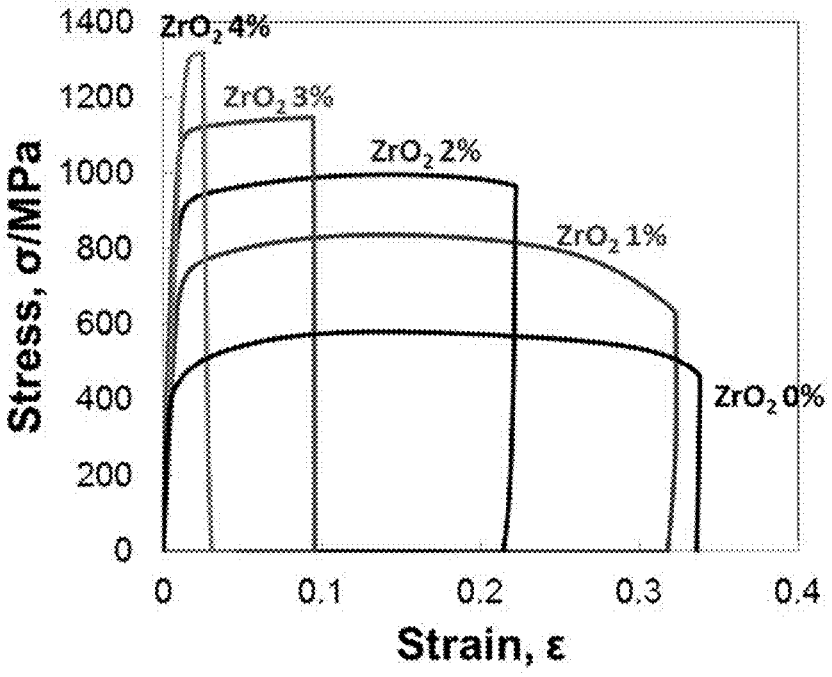
FIG. 35 is a stress-elongation diagram of Ti+$ZrO_2$-based mixed powder sintered extruded material.

The results are shown in FIG. 35 and Table 5.

TABLE 5

| Sintered extruded material | Yield strength (YS) MPa | Tensile strength (UTS) MPa | Elongation % | Micro Vickers hardness Hv0.05 |
|---|---|---|---|---|
| Pure Ti | 442 | 583 | 34.2 | 241 |
| Pure Ti + 1mass % $ZrO_2$ | 699 | 850 | 33.2 | 284 |
| Pure Ti + 2mass % $ZrO_2$ | 937 | 1034 | 21.7 | 349 |
| Pure Ti + 3mass % $ZrO_2$ | 1095 | 1162 | 8.2 | 442 |
| Pure Ti + 4mass % $ZrO_2$ | 1252 | 1317 | 2.1 | 494 |

As will be clear from the results of FIG. 35 and Table 5, the Ti+$ZrO_2$ sintered extruded material shows a considerable rise in the yield strength (YS) and the tensile strength (UTS) as compared with pure Ti. On the other hand, when the amount of addition of $ZrO_2$ increases, the elongation decreases. Specifically, when the amount of $ZrO_2$ is 4.0 mass %, the elongation considerably decreases.

When the sintered extruded material is used as a structural material, it is not regarded as a problem if the elongation value is 5% or more. From such a viewpoint, the Ti+3.0 mass % $ZrO_2$ sintered extruded material can be satisfactorily used as a structural material because of having an elongation value of 8.2%.

From the results of Table 5, it seems that the amount of addition of $ZrO_2$ particles (relative to the total mixed powder) is preferably set to be about 0.5 mass % to 3.5 mass %.

[Method of Production and Result of Tensile Test of Ti+$ZrO_2$-Based Mixed Powder Sintered Extruded Material as Well as Preferable Sintering Temperature]

(1) Powder Mixing Step

A pure Ti powder fabricated by the hydrogenation-dehydrogenation method and having an average particle size of 20 μm and zirconium oxide particles ($ZrO_2$) having an average particle size of 2.0 μm were prepared. To the pure Ti powder, 0.02 mass % of oil was added, and the oil was applied onto a Ti powder surface by mixing with a table ball mill for one hour. To the pure Ti powder having the oil applied thereon, $ZrO_2$ particles were added within a range of 3.0 mass % (relative to the total mixed powder), followed by mixing with use of a rocking mill mixing apparatus under the conditions with a frequency of 60 Hz and a mixing time of one hour, thereby to fabricate a mixed powder.

(2) Vacuum Pressing Sintering Step and Homogenizing Heat Treatment Step

Pressurized vacuum sintering was carried out on the above mixed powder with use of a spark plasma sintering machine (SPS) under three types of conditions with a sintering temperature of 1073 K, 1173 K, and 1273 K and under the conditions with a holding time of 10.8 ks, an applied pressure of 30 MPa, and a vacuum degree of 6 Pa or less. On each of the sintered compacts thus fabricated, a heat treatment was carried out in a vacuum electric furnace at 1773 K and 10.8 ks for the homogenizing treatment.

(3) Hot Extrusion Step

The temperature of each of the sintered compacts subjected to the above heat treatment was raised with use of an infrared rapid heating furnace in an Ar gas atmosphere up to 1273 K at a heating rate of 2 K/s and, after each sintered compact was held at the temperature of 1273 K for 300 seconds, hot extrusion forming was immediately carried out with use of a hydraulically driven pressing machine, so as to fabricate an extruded rod material having a diameter ϕ of 10 mm. At that time, the extrusion ratio was set to be 18.5, and the extrusion speed was set to be 3 mm/s in terms of ram speed.

(4) Tensile Test

A tensile test was carried out on the above sintered extruded rod material in an ordinary-temperature ambient air atmosphere, so as to measure the tensile strength (MPa) and the elongation (%). The rate of strain was set to be $5\times10^{-4}$ $s^{-1}$.

Figure 36:
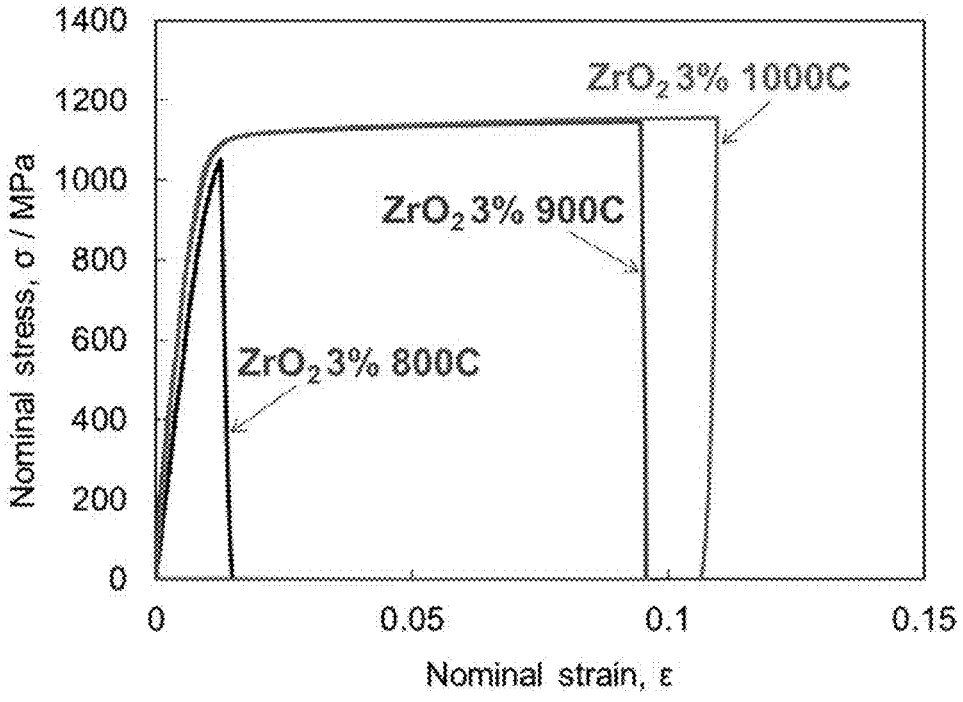
FIG. 36 is a stress-elongation diagram of Ti+$ZrO_2$-based mixed powder sintered extruded material.

The results are shown in FIG. 36 and Table 6.

TABLE 6

| Sintering temperature of sintered extruded material (pure Ti + 3 mass % ZrO2) | Yield strength (YS) MPa | Tensile strength (UTS) MPa | Elongation % |
|---|---|---|---|
| 1073K | 1032 | 1043 | 0.2 |
| 1173K | 1095 | 1162 | 8.2 |
| 1273K | 1098 | 1173 | 10.1 |

(1) Sintering Temperature of Sintered Extruded Material (Pure Ti+3 Mass % $ZrO_2$)

As will be clear from FIG. 36 and Table 6, the elongation after fracture considerably rises when the sintering temperature is set to be 1173 K or higher. In the sintering process of 1073 K, though the added $ZrO_2$ particles are thermally decomposed, ductility is not obtained because sintering between the Ti powders constituting the base texture is not sufficient and, as a result of this, the elongation value considerably decreases.

When the sintered extruded material is used as a structural material, it is not regarded as a problem if the elongation value is 5% or more. From such a viewpoint, the Ti+3.0 mass % $ZrO_2$-based sintered extruded materials in the cases in which the sintering temperature is set to be 1173 K and 1273 K can be satisfactorily used as a structural material because of having elongation values of 8.2% and 10.1%, respectively.

From the results of Table 6, it seems that the sintering temperature in fabricating a Ti-based sintered extruded material in which zirconium atoms and oxygen atoms are dissolved as solutes of solid solution with use of a mixed powder of Ti powder+$ZrO_2$ particles is preferably set to be 1123 K or higher.

INDUSTRIAL APPLICABILITY

The oxygen solid solution titanium sintered compact and the method for producing the same according to the present invention can be advantageously used in obtaining a high-strength titanium material.

The invention claimed is:

1. A method for producing an oxygen solid solution titanium material sintered compact, comprising:

a step of mixing a combination of materials, the combination of materials consisting of:

at least one of (1) an uncoated titanium component powder made of a titanium component having an α-phase, or (2) an oil coated titanium component powder made of the titanium component and an oil; and oxide particles of a metal other than titanium;

a step of applying a compression force to shape a mixed powder obtained through said mixing; and a step of heating and sintering a compressed shaped compact, which is obtained through said compression shaping, in an environment that does not contain oxygen, wherein said sintering step comprises:

decomposing said metal oxide into metal atoms and oxygen atoms;

dissolving the oxygen atoms, which have been dissociated from said metal oxide, as a solute of solid solution into a crystal lattice of the titanium component; and allowing the metal atoms, which have been dissociated from said metal oxide, to remain in a matrix of the titanium component, and wherein an average particle size of said metal oxide particles is 1 μm to 10 μm, an amount of said metal oxide particles is within a range of 0.1% to 7% in terms of mass with respect to the total mixed powder, and a lower limit of a heating and sintering temperature of said environment in the step of heating and sintering the compressed shaped compact is 700° C., and an upper limit of the heating and sintering temperature is a lower one of a temperature equal to or lower than a boiling point of the metal constituting said metal oxide and a temperature equal to or lower than a melting point of said titanium component.

2. The method for producing an oxygen solid solution titanium material sintered compact according to claim 1, wherein said oxide particles are oxide particles of a metal selected from the group consisting of Si, Ta, Cu, Nb, Co, Fe, Mn, V, Sn, Cr, Al, Be, Zr, and Mg.

3. The method for producing an oxygen solid solution titanium material sintered compact according to claim 1, wherein the metal atoms dissociated from said metal oxide are dissolved as a solute of solid solution into the crystal lattice of said titanium component by a treatment of said heating and sintering.

4. The method for producing an oxygen solid solution titanium material sintered compact according to claim 1, wherein the metal atoms dissociated from said metal oxide react with said titanium component by a treatment of said heating and sintering to form a compound to be dispersed in said matrix.

5. The method for producing an oxygen solid solution titanium material sintered compact according to claim 1, wherein the metal atoms dissociated from said metal oxide are deposited in the matrix of said titanium component by a treatment of said heating and sintering.

6. The method for producing an oxygen solid solution titanium material sintered compact according to claim 1, wherein said compression shaping step and said sintering step are simultaneously carried out.

7. The method for producing an oxygen solid solution titanium material sintered compact according to claim 1, further comprising a step of performing a heat treatment for homogenizing a structure of the sintered compact after said sintering step.

8. The method for producing an oxygen solid solution titanium material sintered compact according to claim 1, further comprising a step of performing plastic forming of the sintered compact obtained after said heating and sintering.

9. A method for producing an oxygen solid solution titanium material sintered compact, comprising:

a step of mixing a combination of materials, the combination of materials consisting of:

an oil coated titanium component powder made of a titanium component having an α-phase and an oil; and oxide particles of a metal other than titanium, wherein the oxide particles of the metal are dispersed and adhere onto the surface of titanium component powder particles;

a step of applying a compression force to shape a mixed powder obtained through said mixing; and a step of heating and sintering a compressed shaped compact, which is obtained through said compression shaping, in an environment that does not contain oxygen, wherein said sintering step comprises:

decomposing said metal oxide into metal atoms and oxygen atoms;

dissolving the oxygen atoms, which have been dissociated from said metal oxide, as a solute of solid solution into a crystal lattice of the titanium component; and allowing the metal atoms, which have been dissociated from said metal oxide, to remain in a matrix of the titanium component, and wherein an average particle size of said metal oxide particles is 1 μm to 10 μm, an amount of said metal oxide particles is within a range of 0.1% to 7% in terms of mass with respect to the total mixed powder, and a lower limit of a heating and sintering temperature of said environment in the step of heating and sintering the compressed shaped compact is 700° C., and an upper limit of the heating and sintering temperature is a lower one of a temperature equal to or lower than a boiling point of the metal constituting said metal oxide and a temperature equal to or lower than a melting point of said titanium component.

* * * * *